US009732910B2

(12) United States Patent
Takayanagi et al.

(10) Patent No.: US 9,732,910 B2
(45) Date of Patent: Aug. 15, 2017

(54) PROCESSING-LIQUID SUPPLY APPARATUS AND PROCESSING-LIQUID SUPPLY METHOD

(71) Applicant: TOKYO ELECTRON LIMITED, Minato-ku (JP)

(72) Inventors: Koji Takayanagi, Koshi (JP); Kousuke Yoshihara, Koshi (JP); Yuichi Terashita, Koshi (JP); Toshinobu Furusho, Koshi (JP); Takashi Sasa, Koshi (JP)

(73) Assignee: TOKYO ELECTRON LIMITED, Minato-ku (JP)

( * ) Notice: Subject to any disclaimer, the term of this patent is extended or adjusted under 35 U.S.C. 154(b) by 0 days.

(21) Appl. No.: 14/497,930

(22) Filed: Sep. 26, 2014

(65) Prior Publication Data

US 2015/0090340 A1 Apr. 2, 2015

(30) Foreign Application Priority Data

Oct. 2, 2013 (JP) ..... 2013-207376

(51) Int. Cl.
*F17D 3/01* (2006.01)

(52) U.S. Cl.
CPC ..... *F17D 3/01* (2013.01); *Y10T 137/0318* (2015.04); *Y10T 137/794* (2015.04)

(58) Field of Classification Search
None
See application file for complete search history.

(56) References Cited

U.S. PATENT DOCUMENTS 5,702,597 A * 12/1997 Chevallet ..... A61M 1/1656 210/195.2
2015/0090340 A1* 4/2015 Takayanagi ..... F17D 3/01 137/1

FOREIGN PATENT DOCUMENTS

| | | |
|---|---|---|
| JP | 2001-077015 | 3/2001 |
| JP | 2011-238666 | 11/2011 |
| WO | 2006/057345 | 6/2006 |

* cited by examiner

*Primary Examiner* — Robert James Popovics
(74) *Attorney, Agent, or Firm* — Oblon, McClelland, Maier & Neustadt, L.L.P.

(57) ABSTRACT

A processing-liquid supply apparatus includes a source, a discharge device, a supply channel connecting the source and discharge device, a filter device positioned in the channel to form first side having the source and second side having the discharge device, a pump device positioned in the channel, and a control device which controls suction and discharge by the pump device. The control device controls the pump device such that the liquid is discharged from the discharge device, that remaining of the liquid on the second side is suctioned to be returned to the first side and that the remaining of the liquid returned to the first side flows from the first toward second side together with refill of the liquid from the source, and the control device is set such that return amount of the liquid to the filter device is equal to or greater than amount of the discharge.

20 Claims, 42 Drawing Sheets

5: processing-liquid apparatus
7: discharge nozzle
51: supply pipeline
52: filter device
55: reverse-flow pipeline
55a: first reverse-flow pipeline
55b: second reverse-flow pipeline
60: processing-liquid vessel
70: pump device
100: control computer
101: control device
L: resist liquid
V1~V3, V14: on/off valve 85a: first main reverse-flow pipeline
85b: second main reverse-flow pipeline
85c: secondary reverse-flow pipeline
V24, V25: on/off valve

PROCESSING-LIQUID SUPPLY APPARATUS AND PROCESSING-LIQUID SUPPLY METHOD

CROSS-REFERENCE TO RELATED APPLICATIONS

The present application is based upon and claims the benefit of priority to Japanese Patent Application No. 2013-207376, filed Oct. 2, 2013. The entire contents of this application are incorporated herein by reference.

BACKGROUND OF THE INVENTION

Field of the Invention

The present invention relates to a processing-liquid supply apparatus and a processing-liquid supply method for supplying processing liquid to a surface of a target substrate such as a semiconductor wafer or an LCD glass substrate.

Description of Background Art

Generally, in photolithographic technology for manufacturing semiconductor devices, photoresist is coated on substrates such as semiconductor wafers and FPD substrates (hereinafter referred to as wafers), a resulting resist film is exposed to light through a predetermined circuit pattern, and developing treatment is conducted on the exposed pattern. Accordingly, a circuit pattern is formed on the resist film.

Conventionally, there is a circulatory filtration system for chemical-liquid supply structured to have the following (see JP 2011-238666A): a first vessel and a second vessel to store a chemical liquid (processing liquid); a first pump provided for a first pipeline connecting the first vessel and the second vessel so as to flow the chemical liquid stored in the first vessel to the second vessel; a first filter set in the first pipeline;

a second pipeline connecting the first vessel and the second vessel; and a second pump provided for the second pipeline to flow the chemical liquid stored in the second vessel to the first vessel.

Also, as a liquid processing apparatus of a circulatory filtration system using one filter device, there is a photoresist coating-liquid supply apparatus to have the following (see WO2006/057345A1): a buffer vessel for a resist coating liquid (processing liquid); a circulatory filtration device that pumps out part of the photoresist coating liquid from the buffer vessel, filters the liquid through a filter and returns the liquid to the buffer vessel; and a pipeline to flow the photoresist coating liquid from a buffer vessel or a circulation device to the photoresist coating device. JP 2001-77015A describes a structure where a pump is positioned on each of the upstream side and downstream side of a filter. The entire contents of these publications are incorporated herein by reference.

SUMMARY OF THE INVENTION

According to one aspect of the present invention, a processing-liquid supply apparatus includes a processing-liquid supply source of a processing liquid for processing a target substrate, a discharge device which discharges the processing liquid to the target substrate, a supply channel connecting the processing-liquid supply source and the discharge device such that the processing liquid is supplied to the target substrate, a filter device which is positioned in the supply channel, is forming a first side having the processing-liquid supply source and a second side having the discharge device and removes contaminant from the processing liquid, a pump device which is positioned in the supply channel and suctions and discharges the processing liquid in the supply channel, and a control device which controls suction and discharge by the pump device. The control device controls the pump device such that a discharge portion of the processing liquid flowed to the second side is discharged from the discharge device, that a remaining portion of the processing liquid on the second side is suctioned to be returned to the first side and that the remaining portion of the processing liquid returned to the first side flows from the first side toward the second side together with a refill portion of the processing liquid from the processing-liquid supply source, and the control device is set such that a return amount of the processing liquid to the filter device is equal to or greater than an amount of the discharge portion of the processing liquid.

According to another aspect of the present invention, a method for supplying processing liquid includes flowing a processing liquid from a first side of a filter device to a second side of the filter device through the filter device such that contaminant in the processing liquid is removed, discharging a discharge portion of the processing liquid flowed from the first side of the filter device to the second side of the filter device from a discharge device onto a target substrate, returning a remaining portion of the processing liquid in the second side to the first side of the filter device, and passing the remaining portion of the processing liquid returned to the first side of the filter device together with a refill portion of the processing liquid from a processing-liquid supply source. An amount of the processing liquid returned to the filter device is set to be equal to or greater than an amount of the discharge portion of the processing liquid discharged from the discharge device.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE EMBODIMENTS

Figure 1:
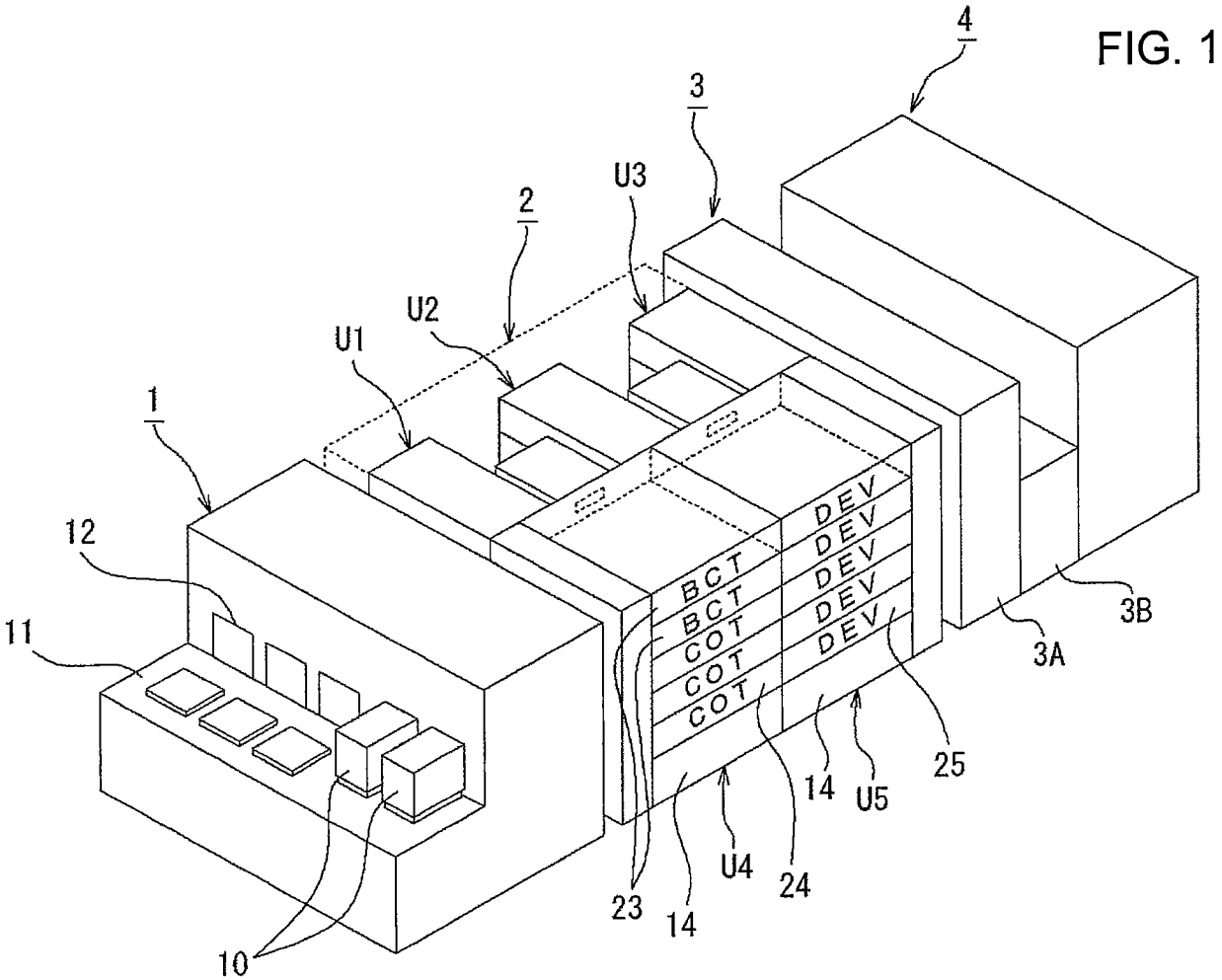
FIG. 1 is a perspective view schematically showing the entire processing system where an exposure treatment apparatus is connected to a coating-developing treatment apparatus that is an application of the liquid processing apparatus according to a first embodiment of the present invention.

The embodiments will now be described with reference to the accompanying drawings, wherein like reference numerals designate corresponding or identical elements throughout the various drawings.

The following is a description of an example where a processing-liquid supply apparatus (resist-liquid processing apparatus) according to an embodiment of the present invention is applied to a coating-developing apparatus.

Figure 2:
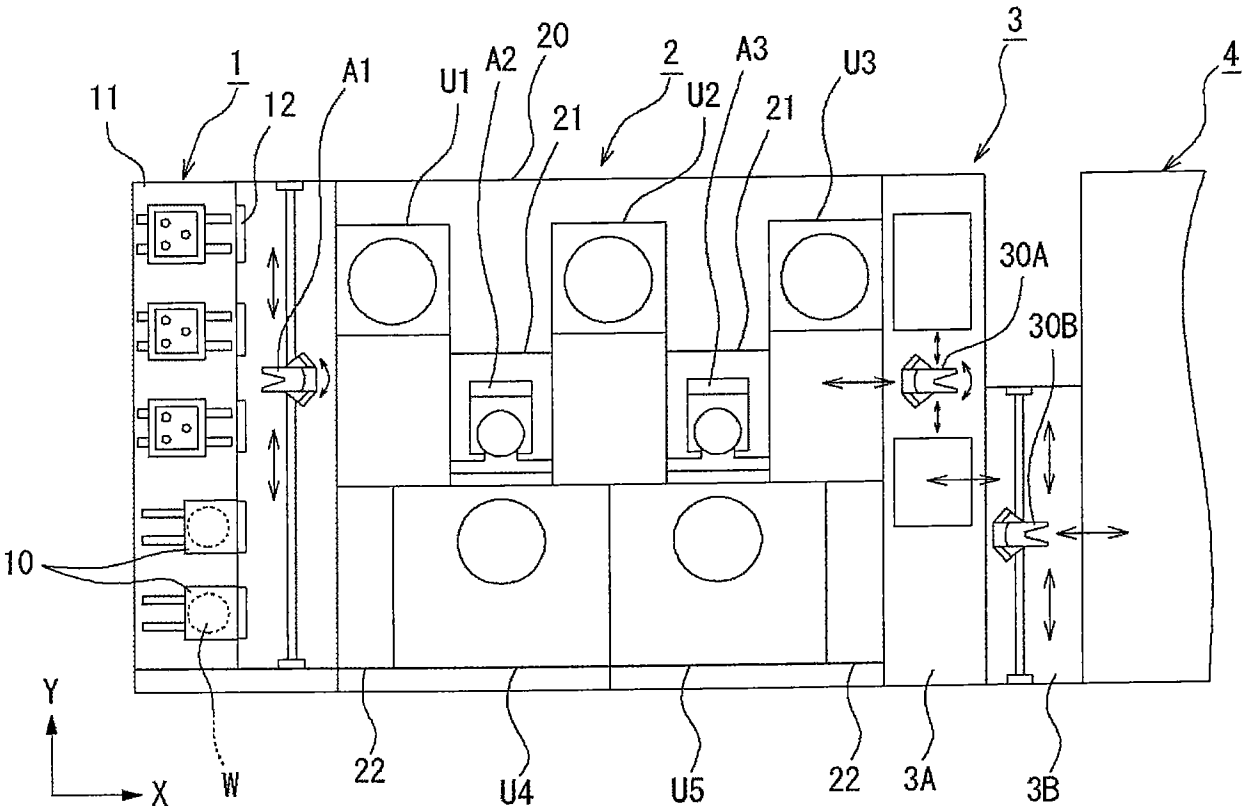
FIG. 2 is a schematic plan view of the processing system.

As shown in FIGS. 1 and 2, the coating-developing apparatus has the following: carrier station 1 to load/unload carrier 10, which seals and accommodates multiple wafers (W), for example, 25 wafers, as target substrates; processing section 2 to perform resist coating, developing or the like on a wafer (W) unloaded from carrier station 1; exposure section 4 to perform immersion lithographic exposure on a surface of the wafer (W) on which a liquid layer capable of transmitting light is formed; and interface section 3, which is provided between processing section 2 and exposure section 4, and is for delivering wafer (W) to/from those sections.

Carrier station 1 has mounting stage 11 capable of positioning multiple carriers 10 side by side, open/close portions 12 formed on a front-side wall of mounting stage 11, and delivery device (A1) to unload a wafer (W) from carrier 10 through an open/close portion.

Interface section 3 is structured with first transfer chamber (3A) and second transfer chamber (3B), positioned to be in front or behind each other between processing section 2 and exposure section 4, and first wafer transfer device (30A) and second wafer transfer device (30B) are provided therein respectively.

In addition, processing section 2, which is surrounded by housing 20, is connected to the back of carrier station 1. In processing section 2, shelf units (U1, U2, U3) structured to have multiple heating or cooling units, and liquid-processing units (U4, U5), and main transfer devices (A2, A3) for delivering a wafer (W) between those units are alternately arranged in that order from closest to farthest from carrier station 1. Main transfer devices (A2, A3) are each positioned in a space surrounded by partition walls 21 formed of a sidewall of shelf unit (U1, U2 or U3) arranged in that order from closest to farthest from carrier station 1, a sidewall of later-described liquid-processing unit (U4 or U5) on the right side, for example, and a back wall on the left side. In addition, temperature-humidity adjustment unit 22, having a device for adjusting the temperature of processing liquid to be used in each unit and ducts for adjusting temperature and humidity, is provided between carrier station 1 and processing section 2 and between processing section 2 and interface section 3.

Shelf units (U1, U2, U3) are each stacked with multiple shelves, 10 shelves, for example, to conduct various processes before and after the process to be performed in liquid-processing units (U4, U5). The combination includes heating units (not shown) to heat (bake) wafers (W) and cooling units (not shown) to cool wafers (W) or the like. Moreover, as shown in FIG. 1, liquid-processing units (U4, U5) for conducting treatments by supplying a predetermined processing liquid to wafer (W) are structured with antireflection-film coating unit (BCT) 23 to coat antireflection film on a wafer (W), coating unit (COT) 24 to coat resist liquid on the wafer (W), developing unit (DEV) 25 to conduct developing treatment by supplying a developing solution to a wafer (W) and so on. Liquid-processing units (U4, U5) are positioned on a chemical-solution storage shelf for a resist liquid, a developing solution or the like, and each have multiple stacked units, for example, 5 units. Coating unit (COT) 24 is a liquid-processing apparatus 5 according to an embodiment of the present invention.

An example of a series of wafer treatments conducted in a coating-developing apparatus structured as above is briefly described with reference to FIGS. 1 and 2. First, carrier 10 with 25 accommodated wafers (W) is placed in mounting stage 11, and the cover of carrier 10 along with open/close portion 12 is opened and a wafer (W) is unloaded by delivery device (A1). Next, the wafer (W) is delivered to main transfer device (A2) by way of a delivery unit (not shown) which is a shelf of shelf unit (U1), and pre-coating treatment, such as an antireflection-film forming process and a cooling process, is conducted. Then, a resist liquid is coated on the wafer (W) in coating unit (COT) 24. After that, the wafer (W) is transferred by main transfer device (A2) to a heating unit, which is one of the shelves of shelf units (U1~U3), and is baked. Further, the wafer (W) is cooled and is transferred to interface section 3 by way of a delivery unit of shelf unit (U3). From interface section 3, the wafer (W) is transferred to exposure section 4 by way of first wafer transfer device (30A) and second wafer transfer device (30B) in first transfer chamber (3A) and second transfer chamber (3B) respectively. An exposure device (not shown) is positioned to face the front surface of the wafer (W) to conduct exposure treatment. After the exposure treatment, the wafer (W) is transferred back taking a reverse route until it reaches main transfer device (A2). In developing unit (DEV) 25, developing is conducted on the wafer (W) so that patterns are formed. After that, the wafer (W) is returned to the original carrier 10 placed in mounting section 11.

Next, a liquid-processing apparatus 5 according to a first embodiment of the present invention is described.

First Embodiment

Figure 3:
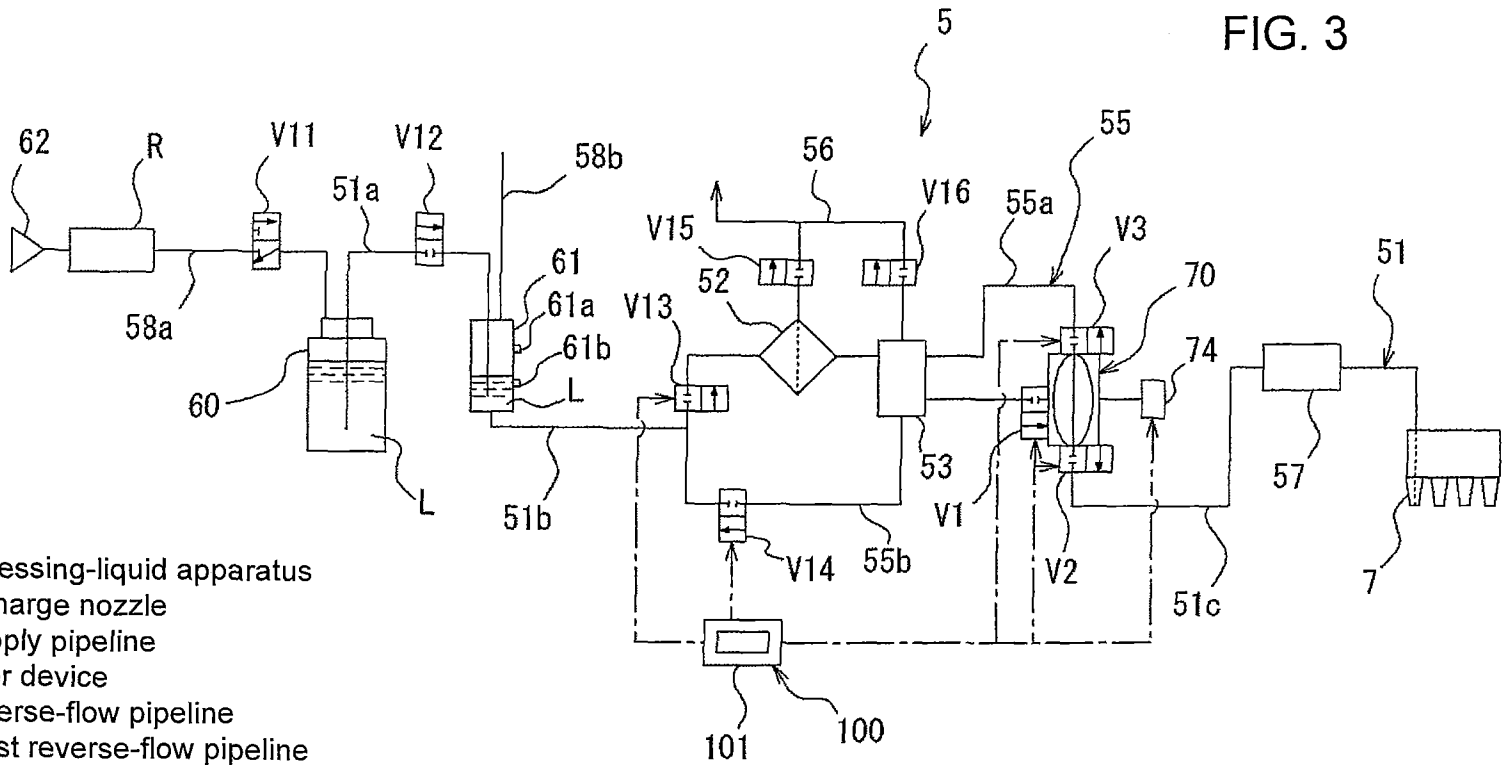
FIG. 3 is a cross-sectional view schematically showing a liquid processing apparatus of the first embodiment.

As shown in FIG. 3, liquid-processing apparatus 5 according to an embodiment of the present invention has the following: processing-liquid vessel 60 as a processing-liquid supply source to store resist liquid (L) as a processing liquid; discharge nozzle 7 as a portion to discharge (supply) resist liquid (processing liquid) (L) onto a wafer as a target substrate; supply pipeline 51 connecting processing-liquid vessel 60 and discharge nozzle 7; filter (filter device) 52 provided for supply pipeline 51 and to filter resist liquid (L); pump 70 provided for supply pipeline 51 on the downstream side of filter 52; trap tank (trapped-liquid storage section) 53 provided for supply pipeline 51 connecting the downstream side of filter 52 and the upstream side of pump 70; reverse-flow pipeline 55 to form a reverse-flow channel connecting the discharge side of pump 70 and the upstream side of filter 52; first, second and third on/off valves (V1~V3) provided for pump 70 at junctions with channels connected to filter 52, discharge nozzle 7 and reverse-flow pipeline 55 respectively; and control device 101 to control pump 70, and first, second and third on/off valves (V1~V3).

In the first embodiment, reverse-flow pipeline 55, connecting the discharge side of pump 70 and the upstream side of filter 52, corresponds to first reverse-flow pipeline (55*a*) connecting pump 70 and trap tank 53 and second reverse-flow pipeline (55*b*) connecting trap tank 53 and second processing-liquid supply pipeline (51*b*) on the upstream side of filter 52.

Supply pipeline 51 is formed of the following: first processing-liquid supply pipeline (51*a*) connecting processing-liquid vessel 60 and buffer tank 61, which temporarily stores resist liquid (L) drawn from processing-liquid vessel 60; second processing-liquid supply pipeline (51*b*) connecting buffer tank 61 and pump 70; and third processing-liquid supply pipeline (51*c*) connecting pump 70 and discharge nozzle 7. Filter 52 is provided for second processing-liquid supply pipeline (51*b*), and trap tank 53 is provided for second processing-liquid supply pipeline (51*b*) on the downstream side of filter 52. In addition, at third processing-liquid supply pipeline (51*c*), supply control valve 57 is provided so as to control the supply of resist liquid (L) to be discharged from discharge nozzle 7. Moreover, drain pipeline 56 is provided for filter 52 and trap tank 53 to drain bubbles generated in resist liquid (L).

In the upper portion of processing-liquid vessel 60, first gas-supply pipeline (58*a*) is provided to be connected to gas supply source 62 for supplying inactive gas such as nitrogen (N2) gas. Also, electric-pneumatic regulator (R), which is a pressure adjustment mechanism capable of making variable adjustments, is provided for first gas-supply pipeline (58*a*). Electric-pneumatic regulator (R) has an operation member, for example, a proportional solenoid, that operates according to a control signal from later-described control device 101, and has a valve mechanism that opens/closes according to the operation of the solenoid. The electric-pneumatic regulator is capable of adjusting pressure as the valve mechanism is switched on/off. In addition, at the upper portion of buffer tank 61, second gas-supply pipeline (58*b*) is provided to release inactive gas, for example, N2 gas, accumulated in the upper portion of buffer tank 61.

Electromagnetic on/off valve (V11) is provided between processing-liquid vessel 60 and electric-pneumatic regulator (R) of first gas-supply pipeline (58*a*). Also, electromagnetic on/off valve (V12) is provided for first processing-liquid supply pipeline (51*a*). Furthermore, electromagnetic on/off valve (V13) is provided for second processing-liquid supply pipeline (51*b*) at a position between buffer tank 61 and filter 52, which is the downstream side of the junction between second processing-liquid supply pipeline (51*b*) and second reverse-flow pipeline (55*b*). Yet furthermore, electromagnetic on/off valve (V14) is provided for second reverse-flow pipeline (55*b*), and electromagnetic on/off valves (V15, V16) are provided for drain pipeline 56. On/off valves (V15, V16) are opened when bubbles are exhausted from filter 52 or trap tank 53. On/off valves (V11~V16) and electric-pneumatic regulator (R) are controlled by control signals from control device 101.

In buffer tank 61, upper-limit liquid level sensor (61*a*) and lower-limit liquid level sensor (61*b*) are provided to monitor predetermined liquid levels (level for completion of filling, level for refill requirements) of stored resist liquid (L) and to detect the remaining amount. For resist liquid (L) to be supplied from processing-liquid vessel 60 to buffer tank 61, when the liquid level of resist liquid (L) is detected by upper-limit liquid level sensor (61*a*), on/off valves (V11, V12) are closed so as to stop the supply of resist liquid (L) from processing-liquid vessel 60 to buffer tank 61. Also, when the liquid level of resist liquid (L) is detected by lower-limit liquid level sensor (61*b*), on/off valves (V11, V12) are opened, and the supply of resist liquid (L) starts from processing-liquid vessel 60 to buffer tank 61.

Figure 7:
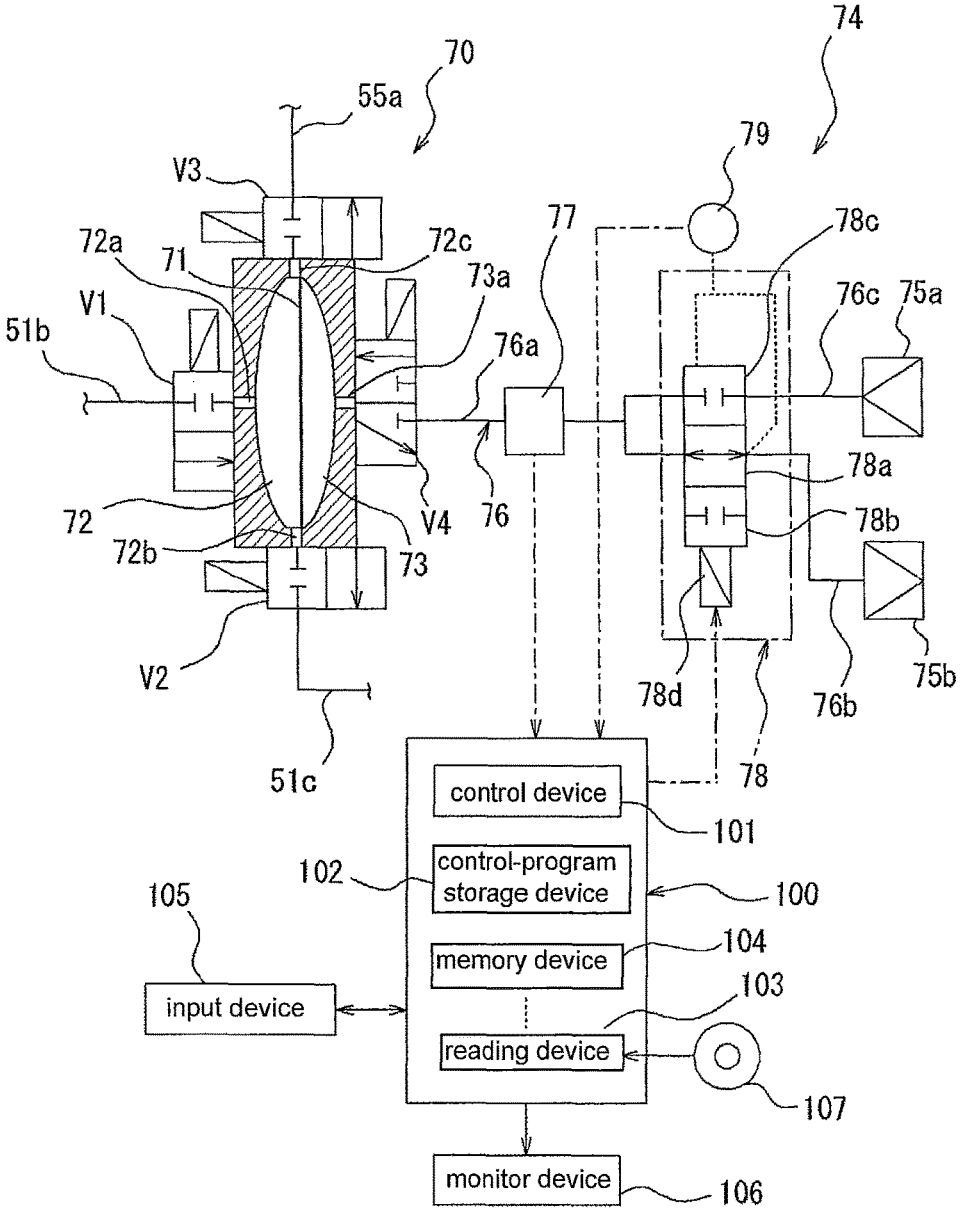
FIG. 7 is a cross-sectional view schematically showing a pump device in the liquid processing apparatus of the first embodiment.
Figure 8:
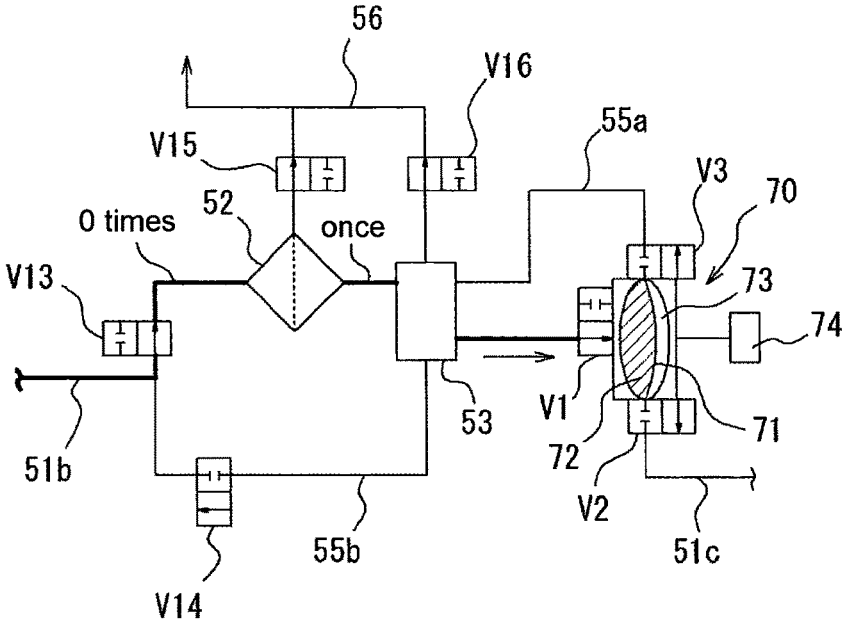
FIG. 8 is a cross-sectional view schematically showing the number of combined filtrations during a first pump-suction operation in the liquid processing apparatus of the first embodiment.

Next, the structure of pump 70 is described in detail by referring to FIG. 7. Pump 70 shown in FIG. 7 is a diaphragm pump, which is a variable displacement pump. Diaphragm pump 70 is divided by flexible diaphragm 71 into pump chamber 72 and driving chamber 73.

In pump chamber 72, the following are provided: upstream-side channel (72*a*) that is connected via on/off valve (V1) to second processing-liquid supply pipeline (51*b*), and is to suction up resist liquid (L) from second processing-liquid supply pipeline (51*b*); downstream-side channel (72*b*) that is connected via on/off valve (V2) to third processing-liquid supply pipeline (51*c*), and is to discharge resist liquid (L) into third processing-liquid supply pipeline (51*c*); and circulation-side channel (72*c*) that is connected via on/off valve (V3) to first reverse-flow pipeline (55*a*), and is to discharge resist liquid (L) into first reverse-flow pipeline (55*a*).

In driving chamber 73, driver device 74 is connected to control decompression and compression of the air in driving chamber 73 according to signals from control device 101. Driver device 74 is equipped with air compression source (75*a*) (hereinafter referred to as compression source (75*a*)), air decompression source (75*b*) (hereinafter referred to as decompression source (75*b*)), flowmeter 77 as a flow sensor, electric-pneumatic regulator 78 and pressure sensor 79.

In driving chamber 73, supply-exhaust channel (73*a*) is formed to be connected to driver device 74 via supply-exhaust switching valve (V4). Pipeline 76 is connected to supply-exhaust channel (73*a*) via supply-exhaust switching valve (V4) so as to be selectively connected to compression source (75*a*) or decompression source (75*b*). Pipeline 76 is formed of main pipeline (76*a*) connected to driving chamber 73, and of exhaust pipeline (76*b*) connected to decompression source (75*b*) and compression pipeline (76*c*) connected to compression source (75*a*), both of which are divided from main pipeline (76*a*). Flowmeter 77 as a flow sensor is provided for main pipeline (76*a*). Electric-pneumatic regulator 78 is set to work as a pressure-adjustment mechanism for exhaust pipeline (76*b*) to adjust exhaust pressure, and as a pressure adjustment mechanism for compression pipeline (76*c*) to adjust compression, namely, air pressure. In such a case, electric-pneumatic regulator 78 is formed with shared connection block (78*a*) capable of selecting connection of exhaust pipeline (76*b*) or compression pipeline (76*c*), two stop blocks (78*b*, 78*c*) to block connection of exhaust pipeline (76*b*) or compression pipeline (76*c*), and electromagnetic switch (78*d*) to switch connection block (78*a*) and stop blocks (78*b*, 78*c*). In addition, pressure sensor 79 is installed in electric-pneumatic regulator 78 to detect the pressure in driving chamber 73 connected by pipeline 76.

In an air supply-exhaust section connected to the driving chamber 73 side of diaphragm pump 70 structured as above, flowmeter 77, pressure sensor 79 and electric-pneumatic regulator 78 of driver device 74 are each electrically connected to control device 101. Then, the exhaust flow rate in pipeline 76 detected by flowmeter 77 and the pressure in pipeline 76 detected by pressure sensor 79 are transmitted (input) to control device 101, and control signals from control device 101 are transmitted (output) to electric-pneumatic regulator 78.

Control device 101 is built into control computer 100 as a memory medium. In addition to control device 101, control computer 100 accommodates control program storage 102 to store control programs, data reading device 103 to read external data, and memory device 104 to record data. In addition, control computer 100 is equipped with input device 105 connected to control device 101, monitor device 106 to display various stages of liquid-processing apparatus 5, and computer-readable memory medium 107 installed in reading device 103. In memory medium 107, software that commands control computer 100 to execute control programs is installed. Control computer 100 is structured to output control signals to each device according to control programs. Control-program storage device 102 stores control programs to be executed as follows: suctioning up resist liquid (L) to pump 70; discharging resist liquid (L) from pump 70 to discharge nozzle 7; supplying resist liquid (L) from pump 70 through reverse-flow pipeline 55 to second processing-liquid supply pipeline (51*b*) on the upstream side of filter 52; combining the resist liquid (L) refilled from buffer tank 61 and the resist liquid (L) returned through reverse-flow pipeline 55; and filtering the combined resist liquid (L) using filter 52 a number of times based on the ratio between the amount of resist liquid (L) discharged from discharge nozzle 7 and the amount of resist liquid (L) returned to second processing-liquid supply pipeline (51*b*) from pump 70 via reverse-flow pipeline 55.

Those control programs are stored in memory medium 107 such as a hard disk, compact disc, flash memory, flexible disk, memory card or the like, and used by installing them from memory medium 107 to control computer 100.

Next, operation of liquid-processing apparatus 5 according to the present embodiment is described by referring to FIG. 4~6 and FIG. 8~13. First, based on control signals from control device 101, on/off valve (V11) provided for first gas supply pipeline (58*a*) and on/off valve (V12) provided for first processing-liquid supply pipeline (51*a*) are each opened, and resist liquid (L) is supplied to buffer tank 61 by using the pressure of N2 gas supplied from N2 gas supply source 62 to processing-liquid vessel 60.

When a predetermined amount of resist liquid (L) is supplied (refilled) in buffer tank 61, on/off valves (V11, V12) are closed according to the control signal from control device 101, which has received a detection signal from upper-limit liquid level sensor (61*a*). At that time, on/off valve (V1) is opened, and on/off valves (V2, V3) are closed. Also, while supply-exhaust switching valve (V4) is switched to the exhaust side, the pressure in driving chamber 73 of diaphragm pump 70 is detected by pressure sensor 79, and the signal of the detected pressure is transmitted (input) to control device 101. Also, on/off valve (V13) is opened after supply-exhaust switching valve (V4) is switched to the exhaust side.

Figure 4:
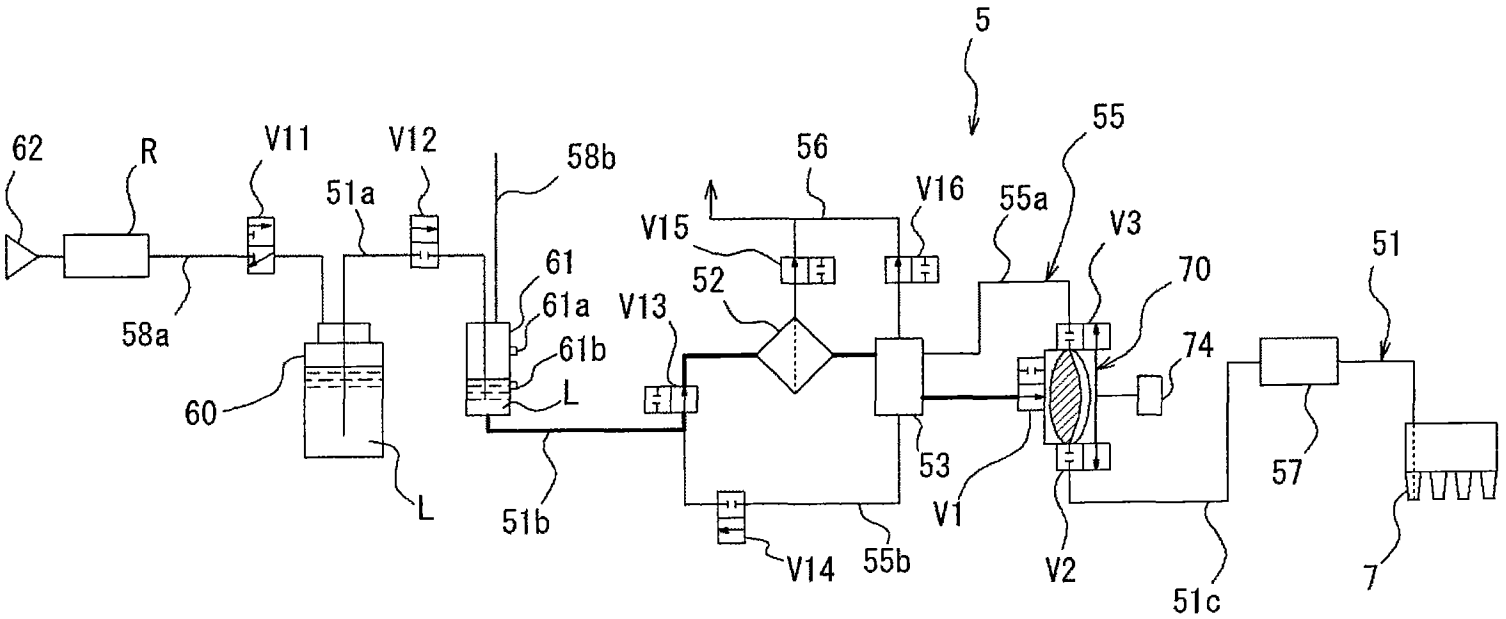
FIG. 4 is a cross-sectional view schematically showing a pump-suction operation in the liquid processing apparatus of the first embodiment.

Next, electric-pneumatic regulator 78 is connected to decompression source (75*b*) so that the air in driving chamber 73 is exhausted as shown in FIG. 4. At that time, the exhaust flow rate is detected by flowmeter 77, and the signal of the detected exhaust flow rate is transmitted (input) to control device 101. By exhausting the air in driving chamber 73, a predetermined amount of resist liquid (L) is suctioned into pump chamber 72 from second processing-liquid supply pipeline (51*b*) (step S1). Since liquid (L) passes through the filter at that time, the number of filtrations of resist liquid (L) is one (see FIG. 8).

Figure 5:
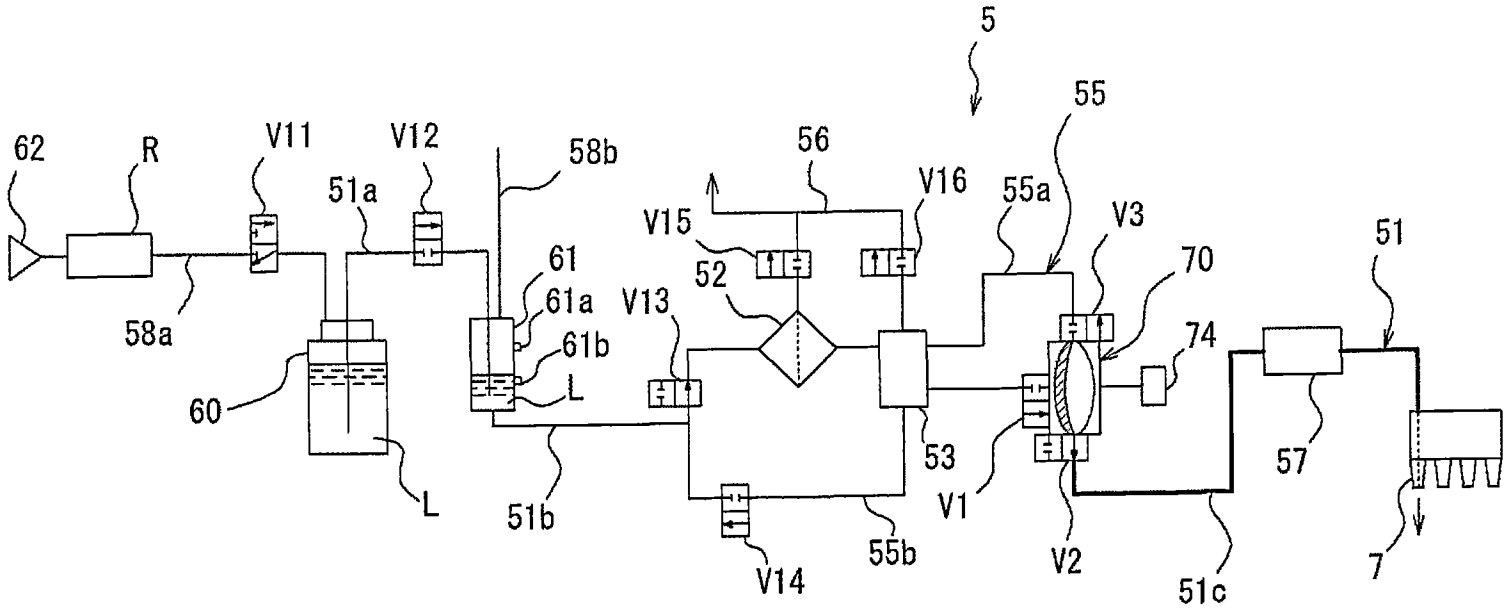
FIG. 5 is a cross-sectional view schematically showing a processing-liquid discharge operation in the liquid processing apparatus of the first embodiment.
Figure 9:
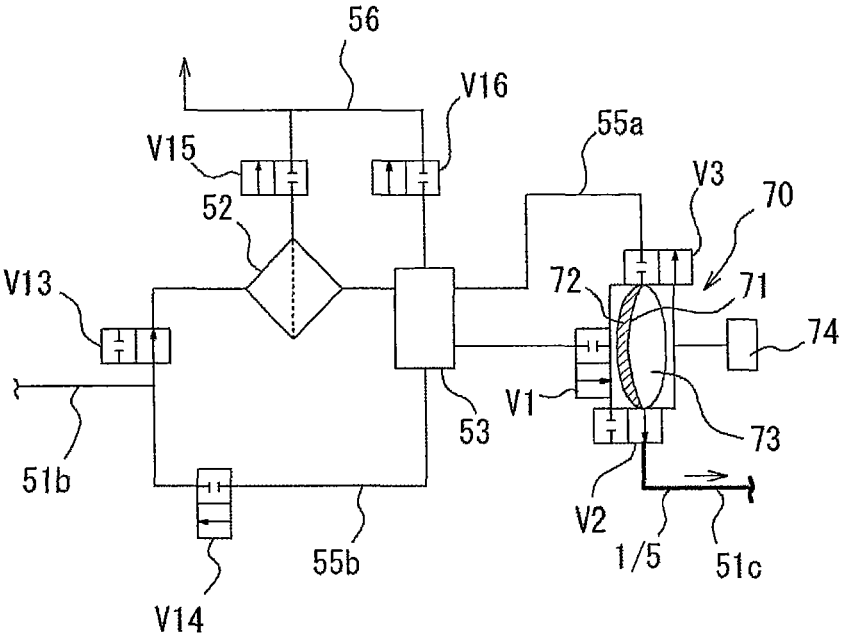
FIG. 9 is a cross-sectional view schematically showing the discharge amount during a processing-liquid discharge operation in the liquid processing apparatus of the first embodiment.

Next, as shown in FIG. 5, on/off valves (V1, V13) are closed, while on/off valve (V2) and supply control valve 57 are opened. At that time, supply-exhaust switching valve (V4) is switched to the supply side, and electric-pneumatic regulator 78 is connected to the compression side so as to supply air to driving chamber 73. Thus, as shown in FIG. 9 as well, a portion (one fifth, for example) of the resist liquid (L) suctioned into pump chamber 72 is discharged through discharge nozzle 7 onto a wafer (step S2).

In the above operation, the amount of resist liquid (L) to be discharged from pump chamber 72 is adjusted by the amount of air supplied to driving chamber 73. Namely, by reducing the amount of air supplied to driving chamber 73, the degree of volume increase of driving chamber 73 is reduced, and the amount of resist liquid (L) discharged onto a wafer thereby decreases. On the other hand, by increasing the amount of air supplied to driving chamber 73, the degree of volume increase of driving chamber 73 increases, and the amount of resist liquid (L) discharged onto a wafer thereby increases. In the present embodiment, one fifth of the resist liquid (L) suctioned to pump chamber 72 is discharged onto a wafer. In addition, the amount of air to be supplied to driving chamber 73 is determined based on the data stored in memory device 104.

Regarding a method for adjusting the amount of resist liquid (L) to be discharged from pump chamber 72, instead of adjusting the amount of air supplied to driving chamber 73, it is an option to adjust the duration of air supply. Alternatively, the air supplied into driving chamber 73 may also be adjusted by pulse signals transmitted from control device 101.

Figure 6:
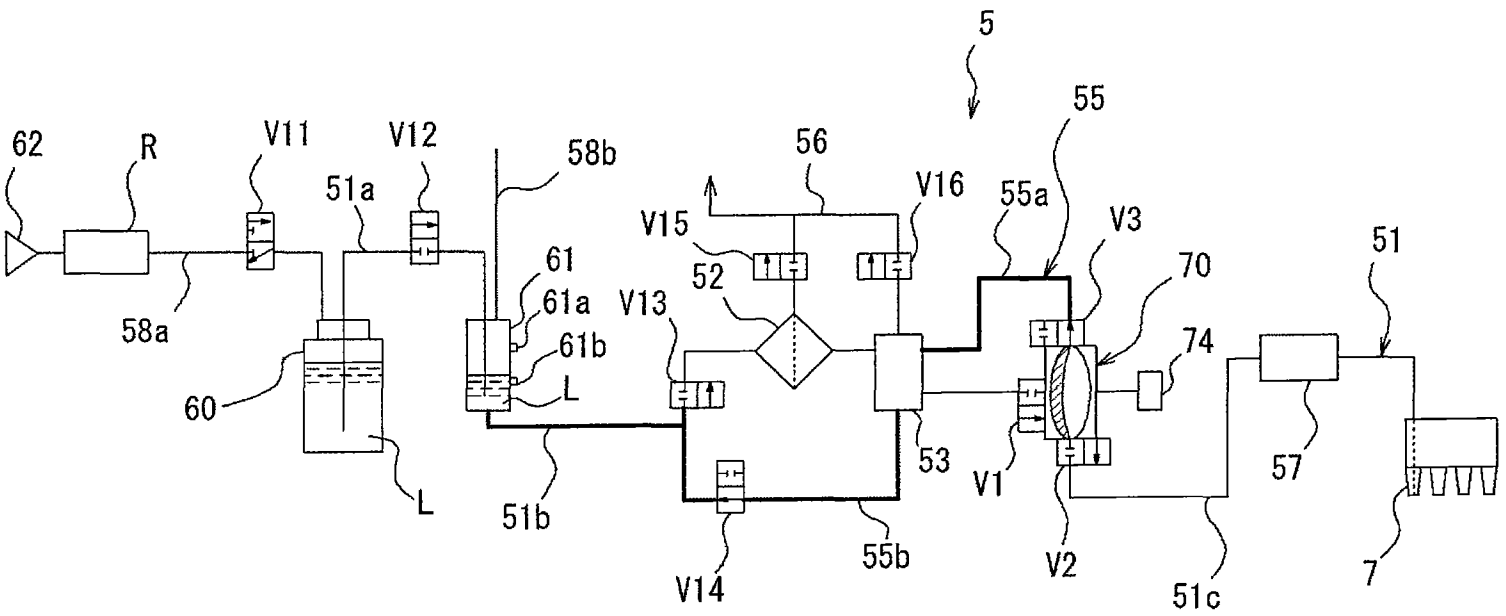
FIG. 6 is a cross-sectional view schematically showing a processing-liquid circulation operation in the liquid processing apparatus of the first embodiment.

Next, as shown in FIG. 6, when on/off valve (V2) is closed and on/off valves (V3, V14) are opened so as to increase the amount of air supplied to driving chamber 73, the rest (four-fifths, for example) of the resist liquid (L) suctioned to pump chamber 72 is returned to second processing-liquid supply pipeline (51*b*) via reverse-flow pipelines (55*a*, 55*b*) (step S3). In the present embodiment, four-fifths of the resist liquid (L) suctioned to pump chamber 72 in step (S1) will be returned to second processing-liquid supply pipeline (51*b*) (see FIG. 10).

Figure 11:
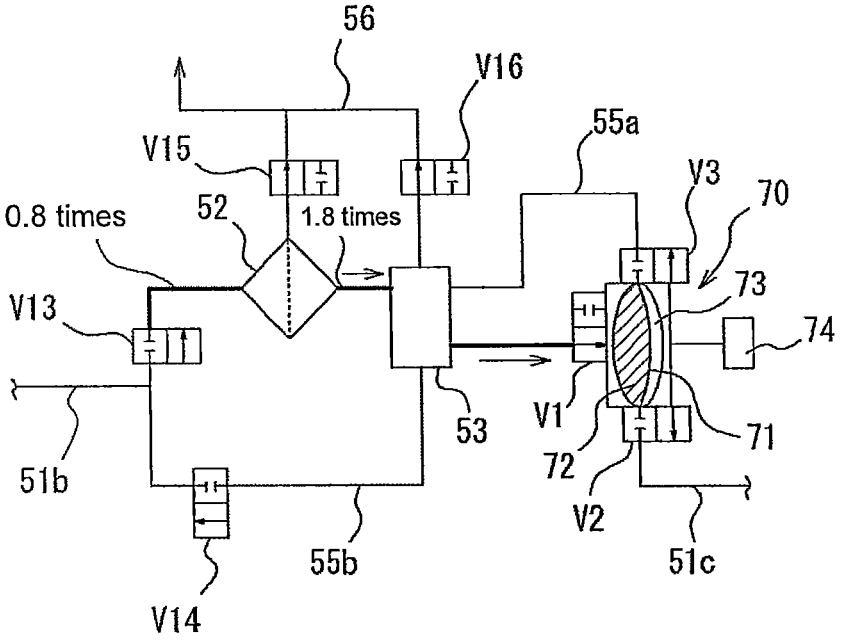
FIG. 11 is a cross-sectional view schematically showing the number of combined filtrations during a second pump-suction operation in the liquid processing apparatus of the first embodiment.

Next, as shown in FIG. 11, when on/off valves (V3, V14) are closed and on/off valves (V1, V13) are opened, the resist liquid (L) that has returned to second processing-liquid supply pipeline (51*b*) is combined with the resist liquid (L) in buffer tank 61, and the combined resist liquid (L) is then suctioned into pump chamber 72, at which time the process is repeated, going back to step (S1). At that time, the amount of resist liquid (L) to be supplied from buffer tank 61 to pump chamber 72 is equal to the amount discharged onto a wafer. Namely, the amount of resist liquid (L) that has been discharged onto a wafer is refilled into pump chamber 72. Therefore, in the present embodiment, one fifth of the resist liquid (L) suctioned to pump chamber 72 will be refilled into second processing-liquid supply pipeline (51*b*) from buffer tank 61.

Here, the resist liquid (L) that has returned to second processing-liquid supply pipeline (51*b*) via reverse-flow pipeline 55 has been filtered by filter 52, but the resist liquid (L) supplied from buffer tank 61 is not filtered by filter 52. Therefore, when the resist liquid (L) that has returned to second processing-liquid supply pipeline (51*b*) via reverse-flow pipeline 55 is combined with the resist liquid (L) that is refilled from buffer tank 61, the following formula (a) shows the relationship of the number of combined filtrations with regard to the amount discharged onto a wafer and the amount returned to second processing-liquid supply pipeline (51*b*) from the resist liquid (L) that has been suctioned to pump chamber 70.

$$An=(a+b)/a-b/a\times\{b/(a+b)\}n-1 \quad (1)$$

Here, "An" is the number of combined filtrations of resist liquid (L) to be discharged onto a wafer, and the number of combined filtrations obtained by formula (1) is referred to as the number of combined circulatory filtrations. In addition, "a" and "b" are values to indicate the amount of resist liquid (L) discharged onto a wafer and the amount returned to reverse-flow pipeline 55 in a ratio of "a" to "b" (a:b). Namely, when the amount of resist liquid (L) discharged onto a wafer and the amount returned to reverse-flow pipeline 55 are (Va) and (Vb) respectively, "a" and "b" are obtained when (Va) and (Vb) are divided by a constant (k). In the subsequent descriptions of the present application, "a" and "b" may be simply referred to as "supply amount" and "return amount."

Figure 13:
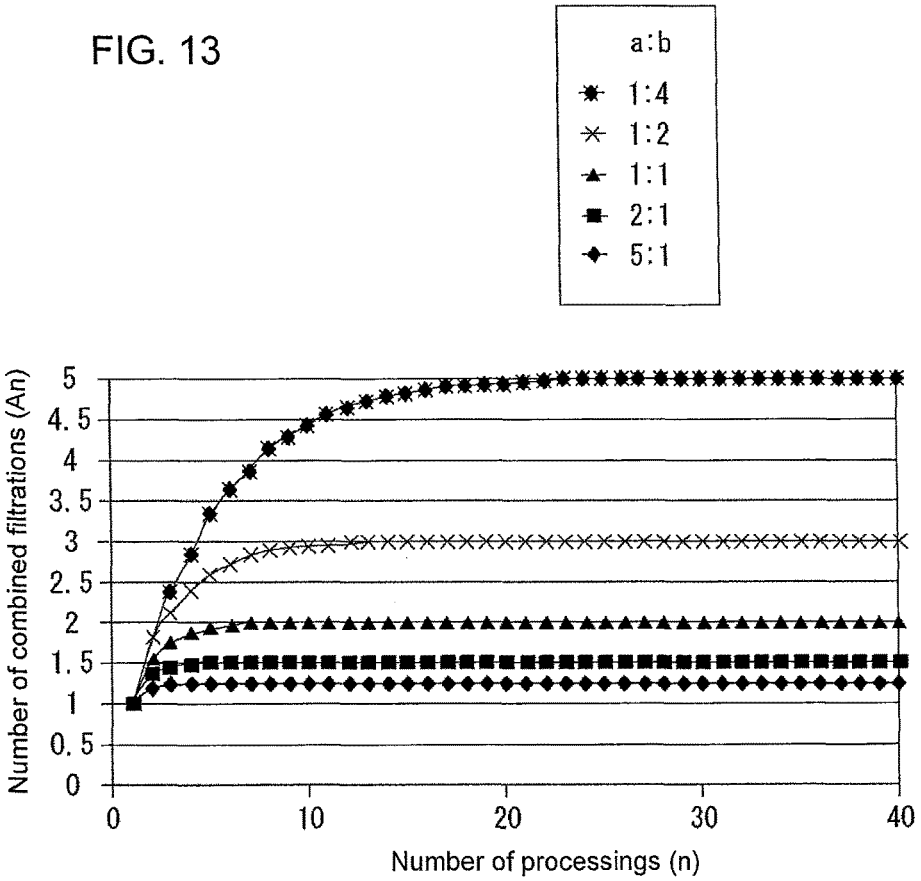
FIG. 13 is a graph showing the number of combined filtrations with respect to a ratio of the discharge amount of a resist liquid onto a wafer to the return amount.
Figure 14:
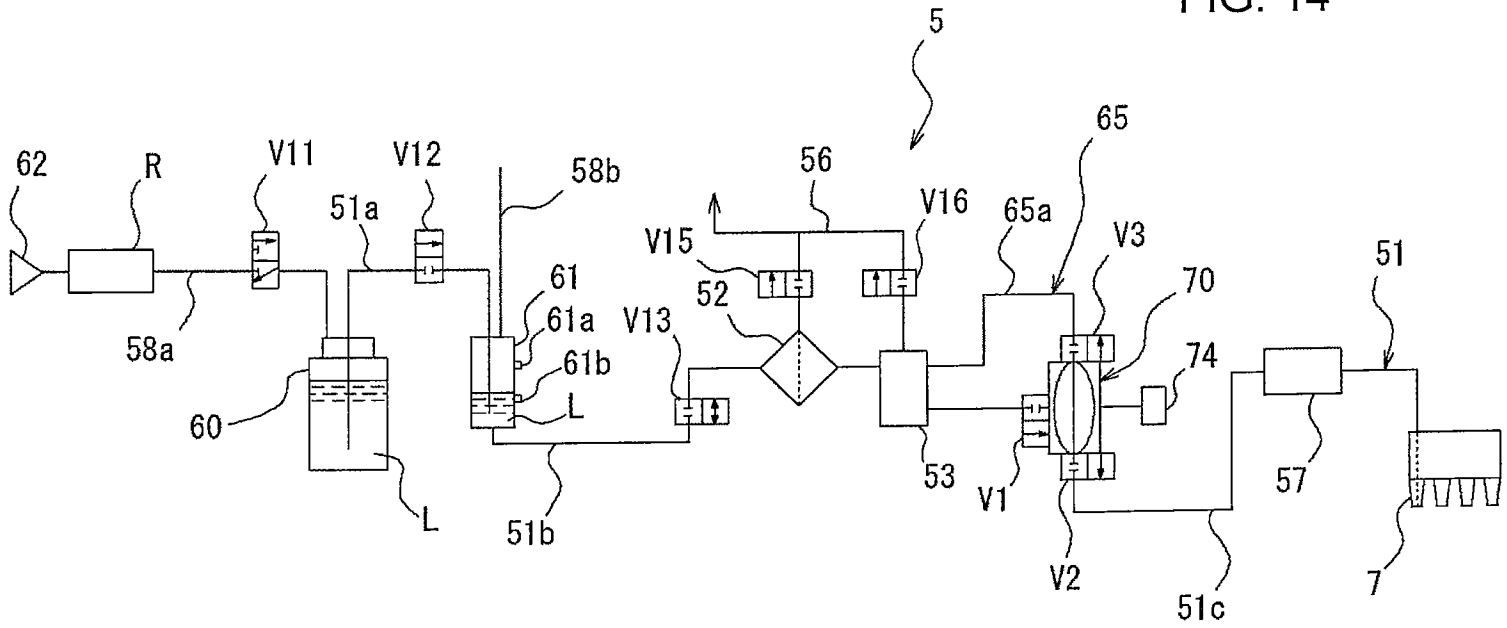
FIG. 14 is a cross-sectional view schematically showing a liquid processing apparatus according to a second embodiment of the present invention.

In addition, "n" indicates the number of times that resist liquid (L) passes through filter 52 (number of processing times). Also, the number of combined filtrations (An) of resist liquid (L) corresponds to the number of filtrations of resist liquid (L) combined at a ratio of the discharge amount to the return amount. From the above formula (1), the number of combined filtrations (An) converges to the value "(a+b)/a" when the number of processing times (n) increases. FIG. 13 is a graph showing the relationships of "An," "n," "a" and "b."

As shown in FIG. 13, when "a"=1 and "b"=4, the number of combined filtrations "An" converges to 5 as the number of processing times "n" increases. In the same manner, when "a"=1 and "b"=2, the number of combined filtrations "An" converges to 3, when "a"=1 and "b"=1, the number of combined filtrations "An" converges to 2, when "a"=2 and "b"=1, the number of combined filtrations "An" converges to 1.5, and when "a"=5 and "b"=1, the number of combined filtrations "An" converges to 1.2.

Figure 10:
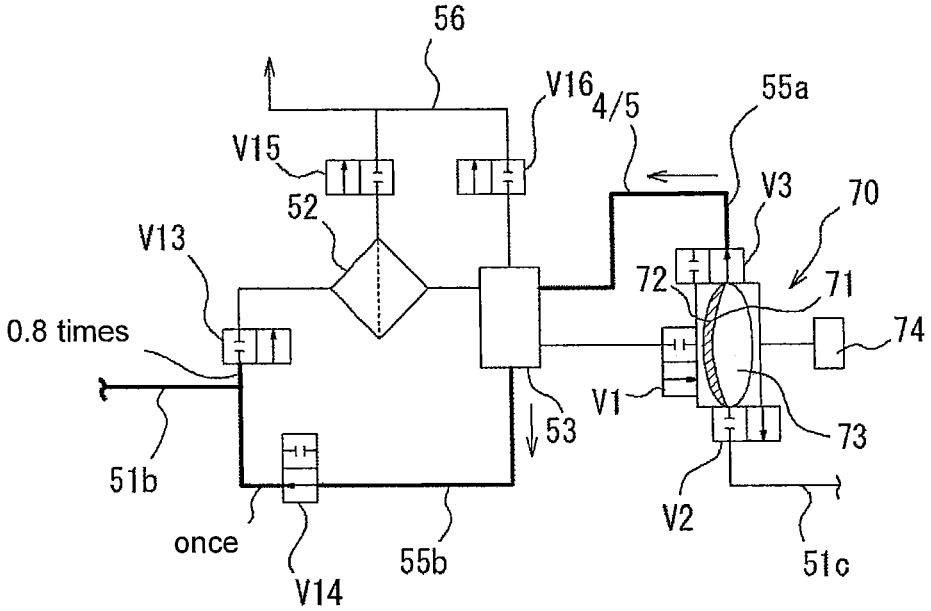
FIG. 10 is a cross-sectional view schematically showing the filtration amount and the number of combined filtrations during a processing-liquid circulation operation in the liquid processing apparatus of the first embodiment.

In the present embodiment, the ratio of flow rates of resist liquid (L) is four to one between the resist liquid (L) returned to second processing-liquid supply pipeline (51*b*) via reverse-flow pipeline 55 and the resist liquid (L) supplied from buffer tank 61. The number of filtrations of the resist liquid (L) returned to second processing-liquid supply pipeline (51*b*) via reverse-flow pipeline 55 is one, and the number of filtrations of the resist liquid (L) supplied from buffer tank 61 is zero. In such a case, as shown in FIGS. 10 and 11, the number of combined filtrations of the resist liquid (L) supplied to second processing-liquid supply pipeline (51*b*) on the upstream side of filter 52 is 0.8. When that resist liquid (L) passes through filter 52, the combined number of filtrations of that resist liquid (L) becomes 1.8.

By repeating steps (S1)~(S3), procedures are repeated where resist liquid (L) is suctioned to pump 70, a portion (one-fifth) of the resist liquid (L) suctioned to pump 70 is discharged onto a wafer, while the rest (four-fifths) of the resist liquid (L) suctioned to pump 70 returns to second processing-liquid supply pipeline (51*b*), and resist liquid (L) is refilled from buffer tank 61. For example, when the ratio is set at 1:4 between the amount discharged onto a wafer and the amount returned to second processing-liquid supply pipeline (51*b*), "a"=1 and "b"=4. Thus, according to the above formula (1), when steps (S1) through (S3) are repeated five times (n=5), the number of combined filtrations "A5" is calculated to be 3.36.

Next, the effects of the first embodiment are described based on the results in Table 1. Table 1 shows the duration needed to conduct steps (S1) through (S3) (cycle time) and the standardized number of particles with respect to the number of combined filtrations "An" of combined circulatory filtration or the later-described combined double-circulatory filtration. "Standardized number of particles" means the ratio between the number of particles when resist liquid (L), on which no filtration or one filtration is conducted, is discharged onto a wafer and the number of particles when resist liquid (L), on which combined circulatory filtration or combined double-circulatory filtration is conducted, is discharged onto a wafer.

TABLE 1

| | number of combined filtrations | discharge amount (mL) | return amount (mL) | cycle time (s) | standardized number of particles | standardized number of particles with regard to one filtration |
|---|---|---|---|---|---|---|
| number of filtrations: 0 | 0 | 0.5 | 0 | — | 100 | — |
| number of filtrations: 1 | 1 | 0.5 | 0 | 25.5 | 22 | 100 |
| combined circulatory filtration | 5 | 0.5 | 2.0 | 24.9 | 17 | 77 |
| combined circulatory filtration | 10 | 0.5 | 4.5 | 35.9 | 7 | 32 |
| combined double-circulatory filtration | 5 | 0.5 | 1.0 | 20.5 | 18 | 82 |
| combined double-circulatory filtration | 10 | 0.5 | 2.3 | 26.0 | 8 | 36 |

In a combined circulatory filtration method where the number of combined filtrations "An" was 5, the cycle time was 24.9 seconds, the standardized number of particles was 17, and the standardized number of particles with regard to one filtration was 77. Therefore, it is found that in a combined circulatory filtration method where the number of combined filtrations "An" was 5, substantially the same cycle time was achieved as that where filtration was conducted once, the number of particles was 17% of that in unfiltered resist liquid (L), and the number of particles was 77% of that in the resist liquid (L) filtered once.

Also, in a combined circulatory filtration method where the number of combined filtrations "An" was 10, the cycle time was 35.9 seconds, the standardized number of particles was 7, and the standardized number of particles with regard to one filtration was 32. Therefore, it is found that in a combined circulatory filtration method where the number of combined filtrations "An" was 10, the number of particles was 7% of that in unfiltered resist liquid (L), and the number of particles was 32% of that in the resist liquid (L) filtered once. In addition, the number of particles was suppressed to be 41% of the number of particles in a combined circulatory filtration method where the number of combined filtrations "An" was 5.

Accordingly, filtration efficiency is enhanced while throughput is secured to be the same level as that where filtration using a filter device was conducted once. Thus, without significantly changing the apparatus, the filtration efficiency using one filter device is achieved to be the same level as that using multiple filter devices, and throughput is prevented from decreasing.

Second Embodiment

Next, a liquid-processing apparatus according to a second embodiment of the present invention is described with reference to FIG. 14~17. In the second embodiment, the same reference numeral is applied to the same portion of the same structure as that in the first embodiment, and its description is omitted here.

In liquid-processing apparatus 5 of the second embodiment, second reverse-flow pipeline (55*b*) and on/off valve (V14) are omitted from the structure of the first embodiment. Reverse-flow pipeline 65 is formed of first reverse-flow pipeline (65*a*) connecting the discharge side of pump 70 and trap tank 53, and of second processing-liquid supply pipeline (51*b*) connecting trap tank 53 and the downstream side of filter 52.

Figure 12:
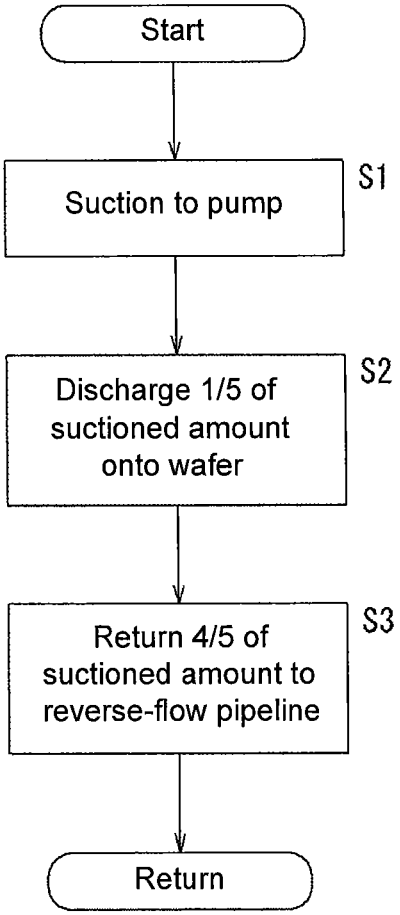
FIG. 12 is a flowchart showing a pump-suction operation, a processing-liquid discharge operation, and a processing-liquid circulation operation in the liquid processing apparatus of the first embodiment.
Figure 15:
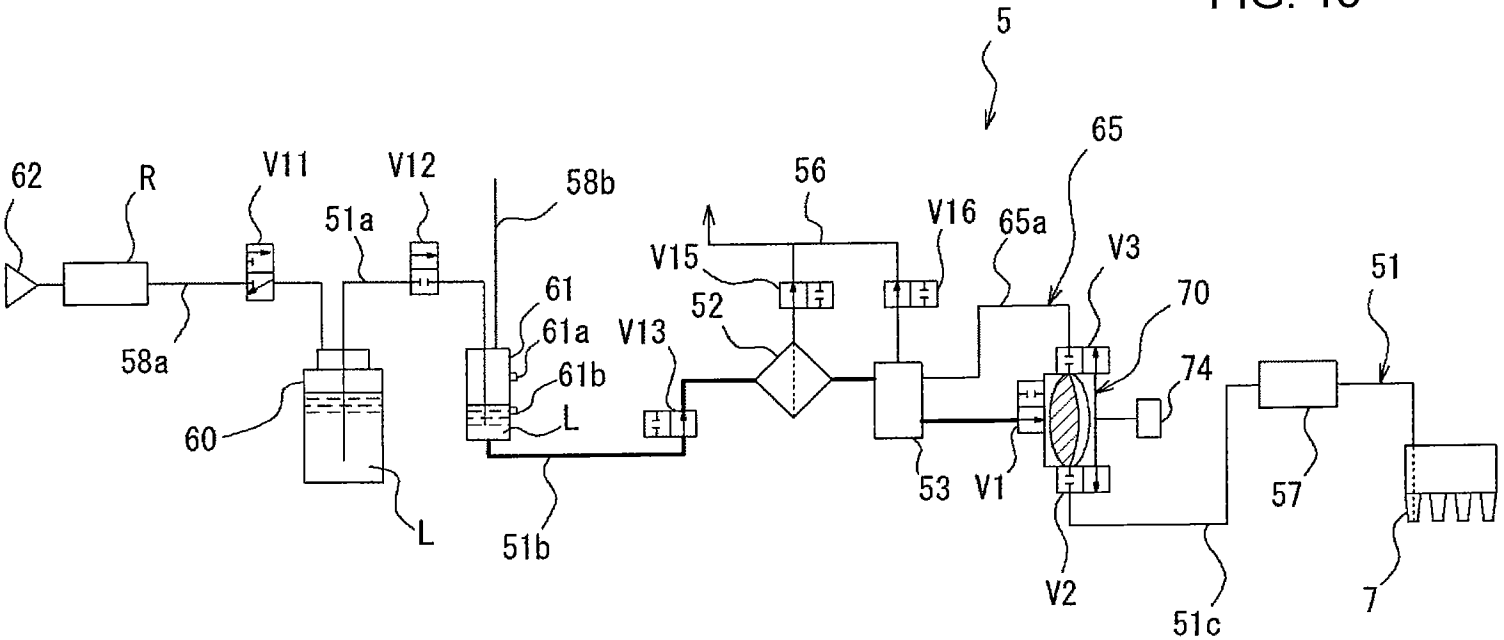
FIG. 15 is a cross-sectional view schematically showing a pump-suction operation in the liquid processing apparatus of the second embodiment.
Figure 16:
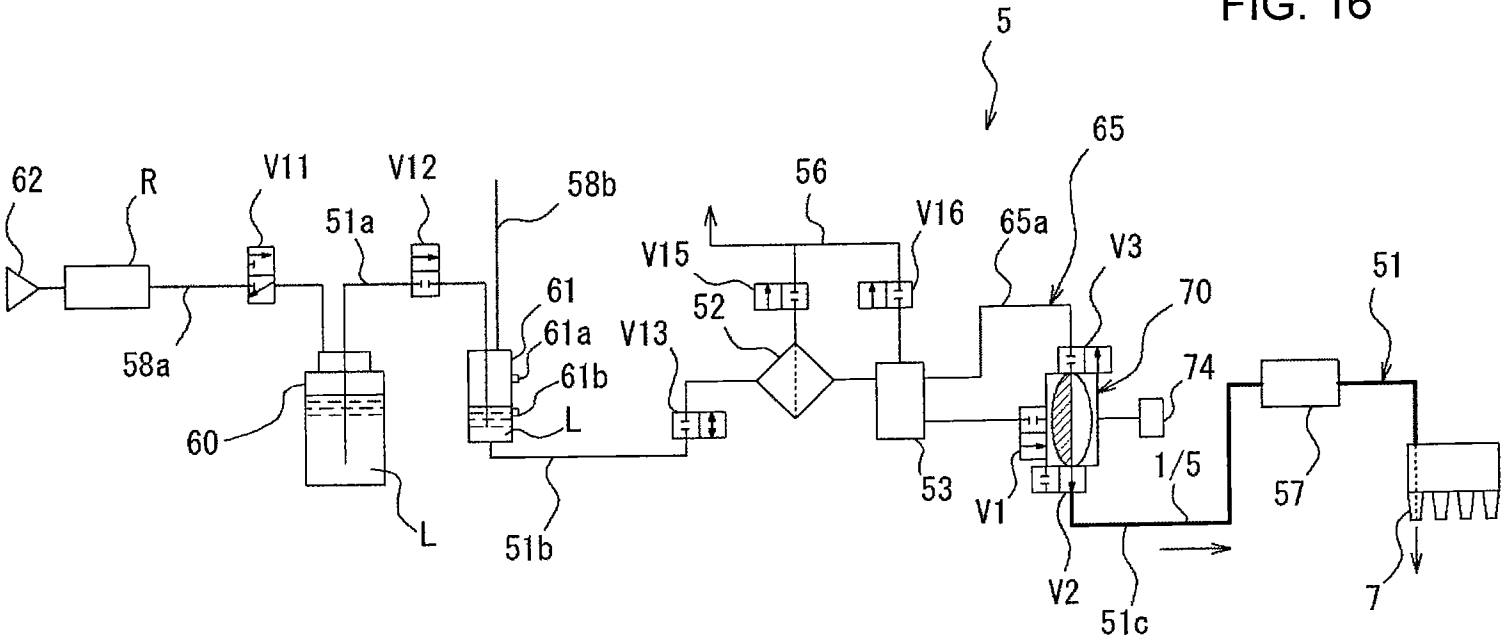
FIG. 16 is a cross-sectional view schematically showing a processing-liquid discharge operation in the liquid processing apparatus of the second embodiment.

Regarding the operations of the second embodiment, among the steps conducted in the first embodiment as shown in FIG. 12, step (S1) (suctioning resist liquid (L) to pump chamber 72 shown in FIG. 15) and step (S2) (discharging resist liquid (L) onto a wafer (W) shown in FIG. 16) are the same, but step (S3) is different. Namely, as shown in FIG. 17, the route of resist liquid (L) is different when resist liquid (L) in pump 70 returns to second processing-liquid supply pipeline (51*b*) on the upstream side of filter 52.

Figure 17:
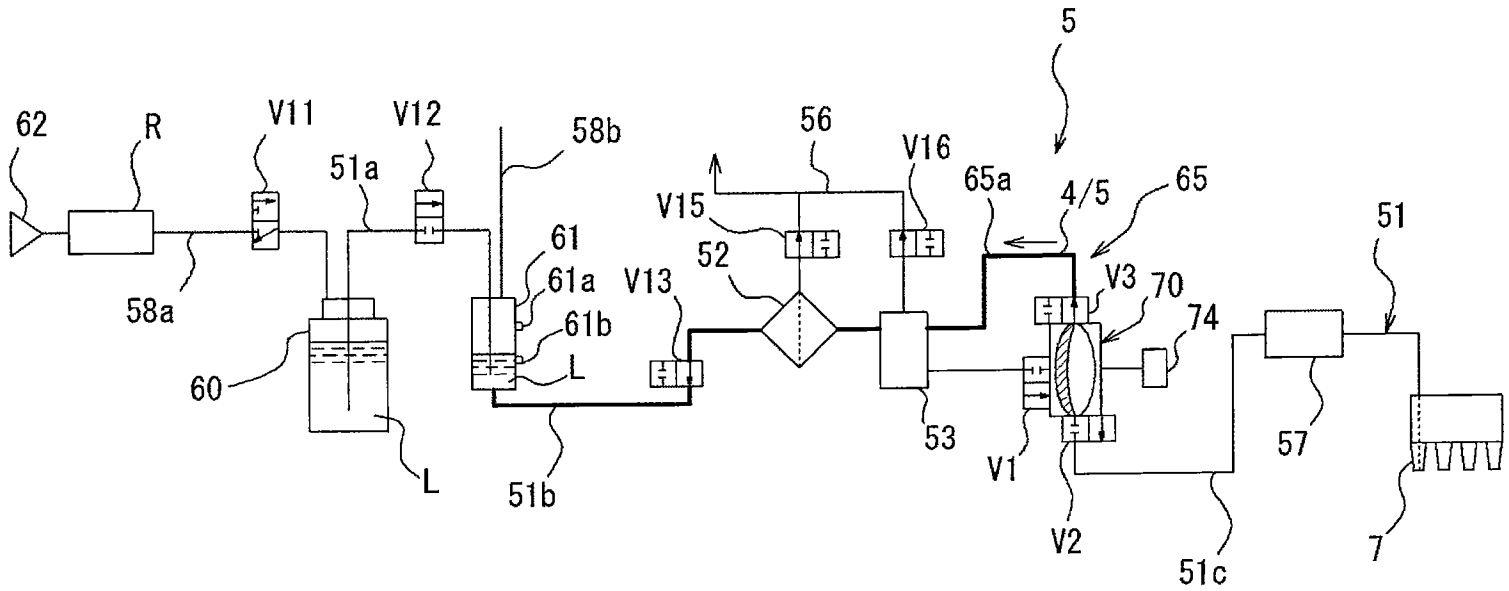
FIG. 17 is a cross-sectional view schematically showing a processing-liquid circulation operation in the liquid processing apparatus of the second embodiment.
Figure 18:
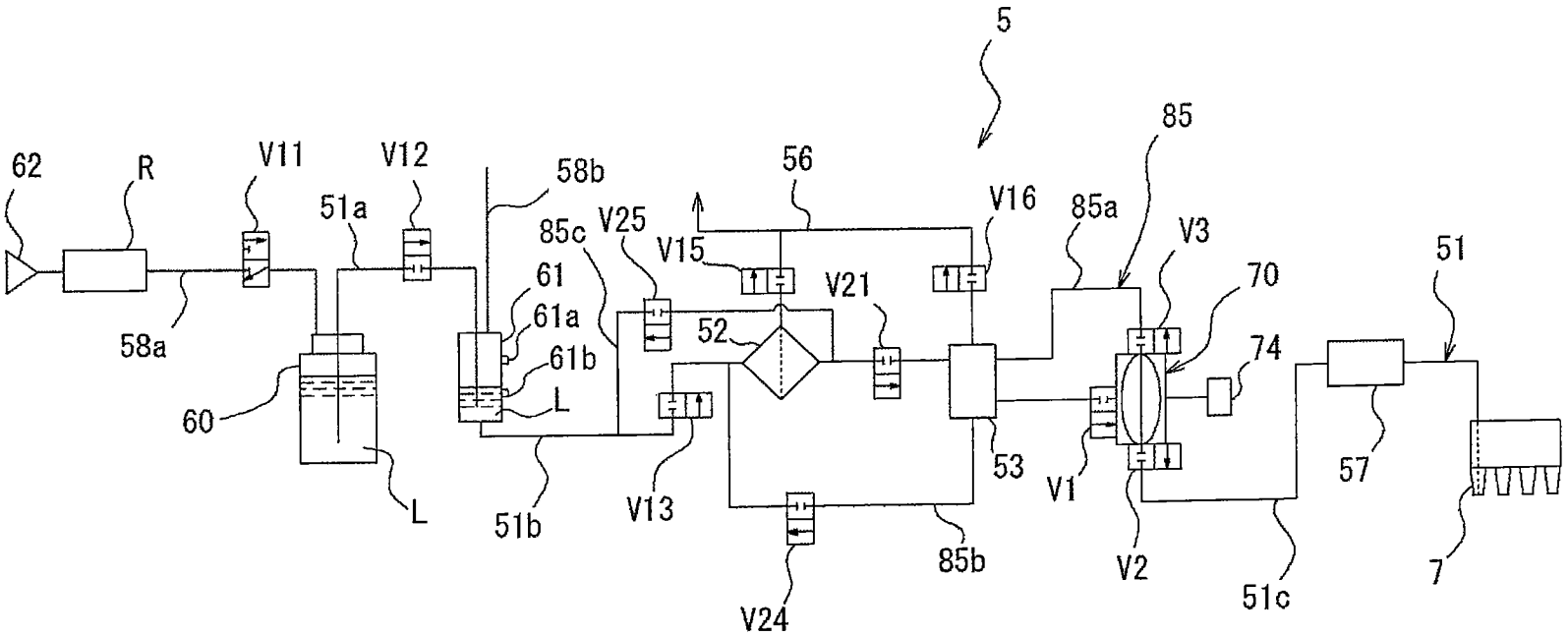
FIG. 18 is a cross-sectional view schematically showing a liquid processing apparatus according to a third embodiment of the present invention.

As shown in FIG. 17, after a portion of the resist liquid (L) in pump 70 is discharged onto a wafer, air is supplied to driving chamber 73, while on/off valves (V1, V2) are closed and on/off valves (V3, V13) are opened, so that the resist liquid (L) in pump chamber 72 is returned to second processing-liquid supply pipeline (51*b*) on the upstream side of filter 52 via reverse-flow pipeline (65*a*) and filter 52. Then, the same as in the first embodiment, the amount of resist liquid (L) equal to the amount discharged onto a wafer (W) is refilled from buffer tank 61. Thus, resist liquid (L) is filtered by filter 52 when it is suctioned to pump 70 as well as when it is returned to second processing-liquid supply pipeline (51*b*).

Therefore, a portion of the resist liquid (L) suctioned to pump 70 is filtered by filter 52 when it passes through first reverse-flow pipeline (65*a*) and second processing-liquid supply pipeline (51*b*), in other words, when it makes a round-trip through second processing-liquid supply pipeline (51*b*) (hereinafter referred to as combined double-circulatory filtration). The number of combined filtrations "An" of resist liquid (L) discharged onto a wafer in this method is obtained by formula (2) below, which shows the relationship of the number of combined filtrations with regard to the amount discharged onto a wafer and the amount returned to second processing-liquid supply pipeline (51*b*) from the resist liquid (L) that has been suctioned to pump 70.

$$An=(a+2b)/a-2b/a\times\{b/(a+b)\}n-1 \quad (2)$$

Here, the number of combined filtrations in formula (2) is referred to as the number of combined double-circulatory filtrations.

For example, when the ratio is set at one to four between the amount discharged onto a wafer and the amount returned to second processing-liquid supply pipeline (51*b*), "a"=1 and "b"=4. Thus, according to the above formula (2), when steps (S1) through (S3) are repeated five times (n=5), the number of combined filtrations "A5" is calculated to be 5.72.

Next, the effects of the second embodiment are described based on the results in Table 1. In a combined double-circulatory filtration method where the number of combined filtrations "An" was 5, the cycle time was 20.5 seconds, the standardized number of particles was 18, and the standardized number of particles with regard to one filtration was 82. Thus, in a combined double-circulatory filtration method where the number of combined filtrations "An" was 5, it is found that the cycle time was shorter than in an example of one filtration, and the number of particles was 18% of that in the unfiltered resist liquid (L), and the number of particles was 82% of that in resist liquid (L) that was filtered once.

In a combined double-circulatory filtration method where the number of combined filtrations "An" was 10, the cycle time was 26.0 seconds, the standardized number of particles was 8, and the standardized number of particles with regard to one filtration was 36. Thus, in a combined double-circulatory filtration method where the number of combined filtrations "An" was 10, it is found that the number of particles was 8% of that in the unfiltered resist liquid (L), and the number of particles was 36% of that in resist liquid (L) that was filtered once. In addition, the number of particles was 44% of that in a combined double-circulatory filtration method where the number of combined filtrations "An" was 5.

Accordingly, the same as in the first embodiment, filtration efficiency is enhanced while throughput is secured to be the same level as that of one filtration. Thus, without significantly changing the apparatus, filtration efficiency using one filter device is achieved to be at the same level as that using multiple filter devices, and throughput is prevented from decreasing.

Moreover, in the combined double-circulatory filtration method of the second embodiment, resist liquid (L) passes through filter 52 again when it returns to second processing-liquid supply pipeline (51*b*). Thus, the number of particles attached to a wafer in the second embodiment is less than that in the first embodiment.

Third Embodiment

Next, a liquid-processing apparatus according to a third embodiment of the present invention is described with reference to FIG. 18~21. In the third embodiment, the same reference numeral is applied to the same portion of the same structure as that in the first and second embodiments, and its description is omitted here.

Reverse-flow pipeline 85 of the third embodiment is formed with first main reverse-flow pipeline (85*a*) and second main reverse-flow pipeline (85*b*) of the main reverse-flow pipeline, along with secondary reverse-flow pipeline (85*c*) connecting the downstream side and the upstream side of filter 52. First main reverse-flow pipeline (85*a*) connects the discharge side of pump 70 and trap tank 53, and second main reverse-flow pipeline (85*b*) connects trap tank 53 and second processing-liquid supply pipeline (51*b*) on the upstream side of filter 52. In such a case, second main reverse-flow pipeline (85*b*) is connected to second processing-liquid supply pipeline (51*b*) between on/off valve (V13) and filter 52. Also, secondary reverse-flow pipeline (85*c*) connects second processing-liquid supply pipeline (51*b*) between filter 52 and trap tank 53 and second processing-liquid supply pipeline (51*b*) between buffer tank 61 and filter 52. A first reverse-flow channel is formed with main reverse-flow pipeline (85*a*) and main reverse-flow pipeline (85*b*), and a second reverse-flow channel is formed with secondary reverse-flow pipeline (85*c*).

Electromagnetic on/off valve (V21) is provided for second processing-liquid supply pipeline (51*b*) between trap tank 53 and the junction of secondary reverse-flow pipeline (85*c*) and second processing-liquid supply pipeline (51*b*) on the downstream side of filter 52. Also, electromagnetic on/off valve (V24) is provided for second main reverse-flow pipeline (85*b*), and electromagnetic on/off valve (V25) is provided for secondary reverse-flow pipeline (85*c*). Those on/off valves (V21, V24, V25) are set to be controllable by control signals from the above control device (not shown).

Figure 19:
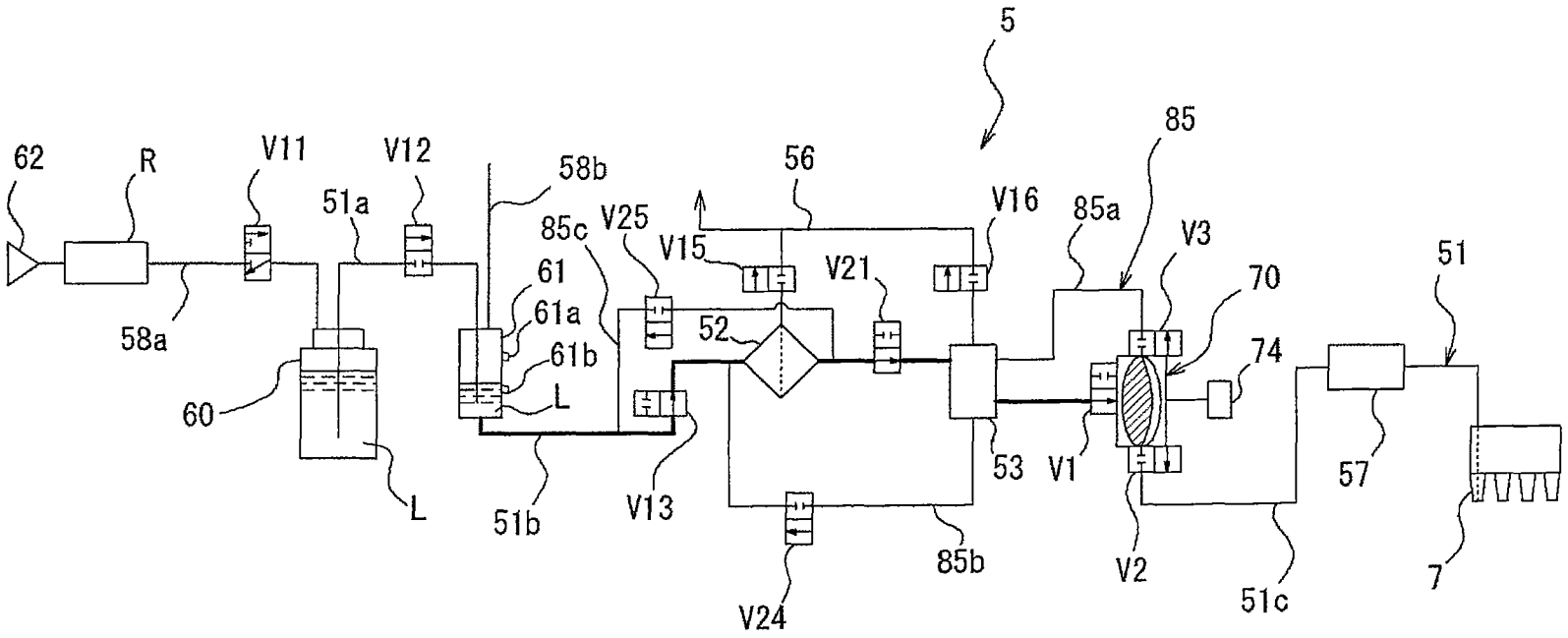
FIG. 19 is a cross-sectional view schematically showing a pump-suction operation in the liquid processing apparatus of the third embodiment.
Figure 20:
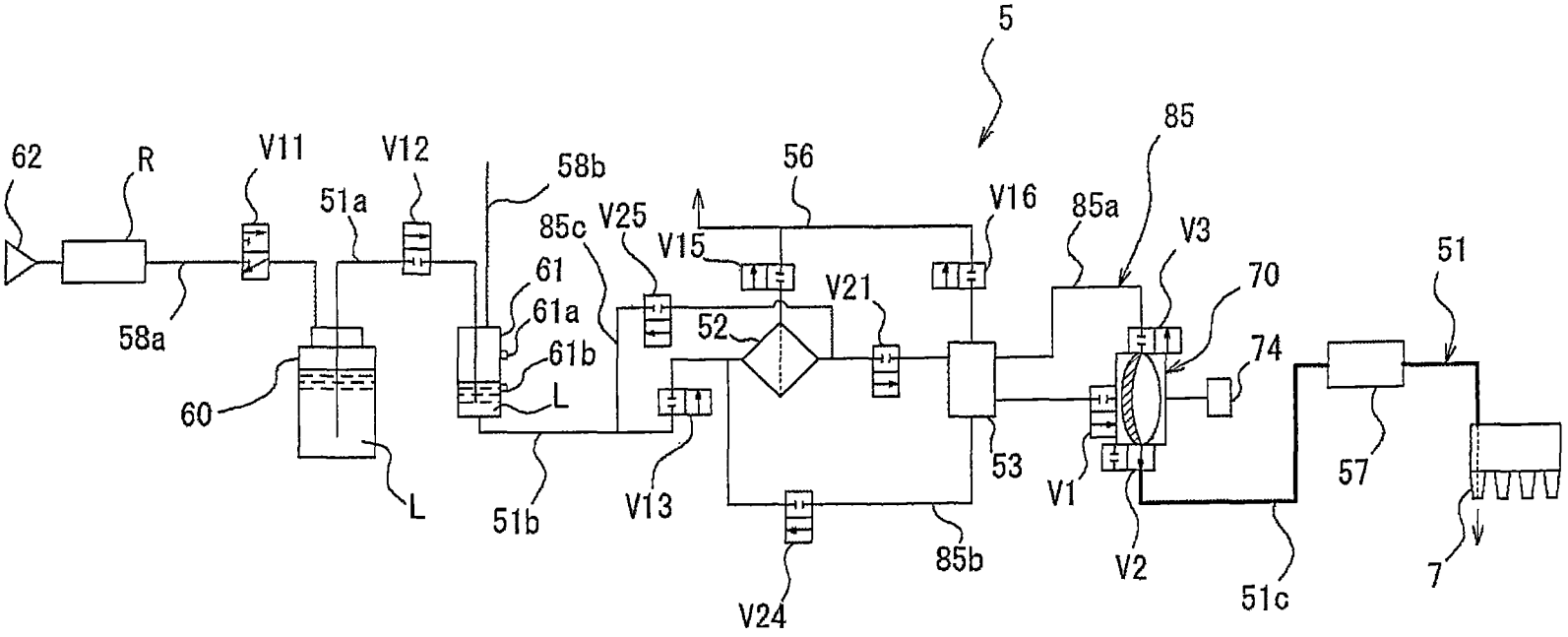
FIG. 20 is a cross-sectional view schematically showing a processing-liquid discharge operation in the liquid processing apparatus of the third embodiment.

In the operations of the third embodiment, among the steps conducted in the first embodiment as shown in FIG. 12, step (S1) (suctioning resist liquid (L) to pump chamber 72 shown in FIG. 19) and step (S2) (discharging resist liquid (L) onto a wafer (W) shown in FIG. 20) are the same, but step (S3) is different.

Figure 21:
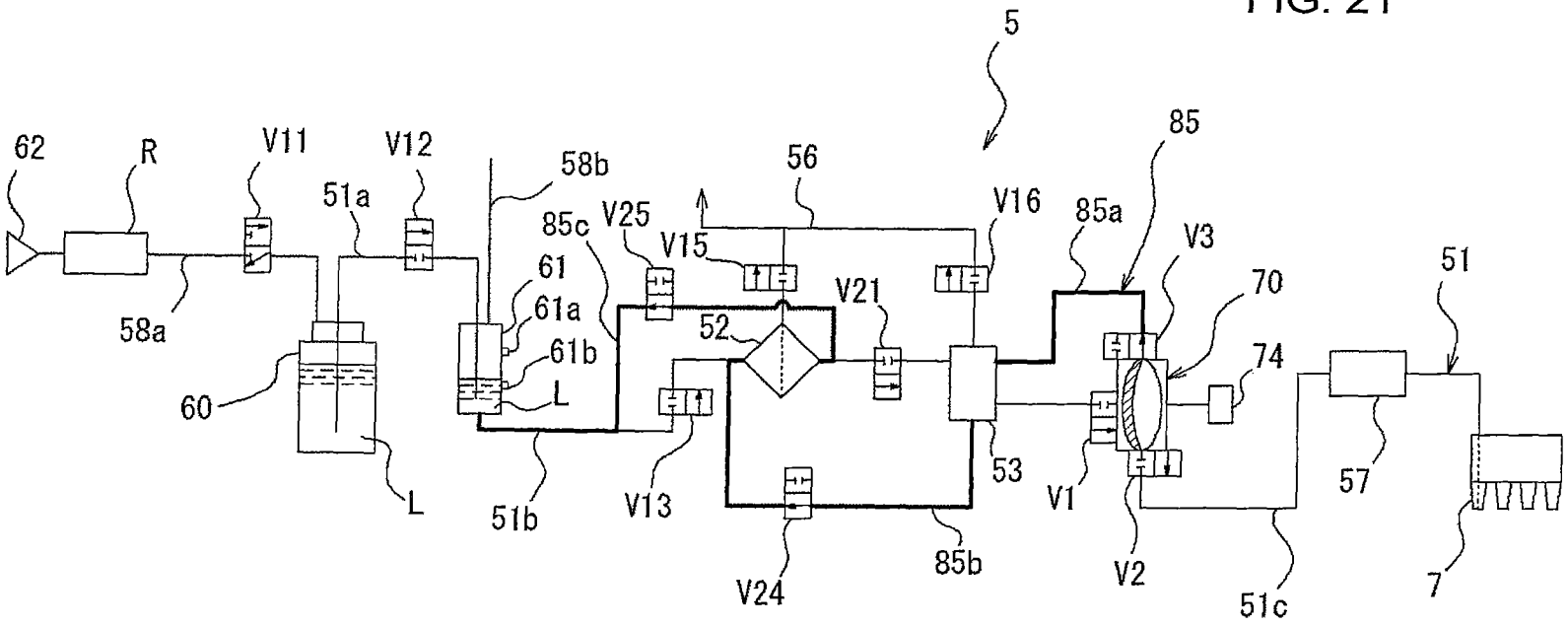
FIG. 21 is a cross-sectional view schematically showing a processing-liquid circulation operation in the liquid processing apparatus of the third embodiment.

Namely, as shown in FIG. 21, when resist liquid (L) in diaphragm pump 70 is returned to second processing-liquid supply pipeline (51*b*) via reverse-flow pipeline 85, on/off valve (V2) is closed while on/off valves (V24, V25) are opened, and driver device 74 is driven so that a portion (four-fifths, for example) of the resist liquid (L) in diaphragm pump 70 flows into reverse-flow pipeline 85.

Next, as shown in FIG. 19, when on/off valves (V3, V24, V25) are closed and on/off valves (V1, V13, V21) are opened, the resist liquid (L) that is returned to second processing-liquid supply pipeline (51*b*) is combined with the resist liquid (L) refilled from buffer tank 61. Then, the process is repeated, going back to step (S1) and the combined resist liquid (L) is suctioned to pump chamber 72.

Accordingly, the same as in the first and second embodiments, filtration efficiency is enhanced while the throughput is secured to be the same level as that where resist liquid is not filtered or is filtered once by a filter device. Thus, without significantly changing the apparatus, the filtration efficiency using one filter device is achieved to be the same level as that using multiple filter devices, and throughput is prevented from decreasing.

Next, modified examples of the third embodiment are described with reference to FIG. 22~25.

Figure 22:
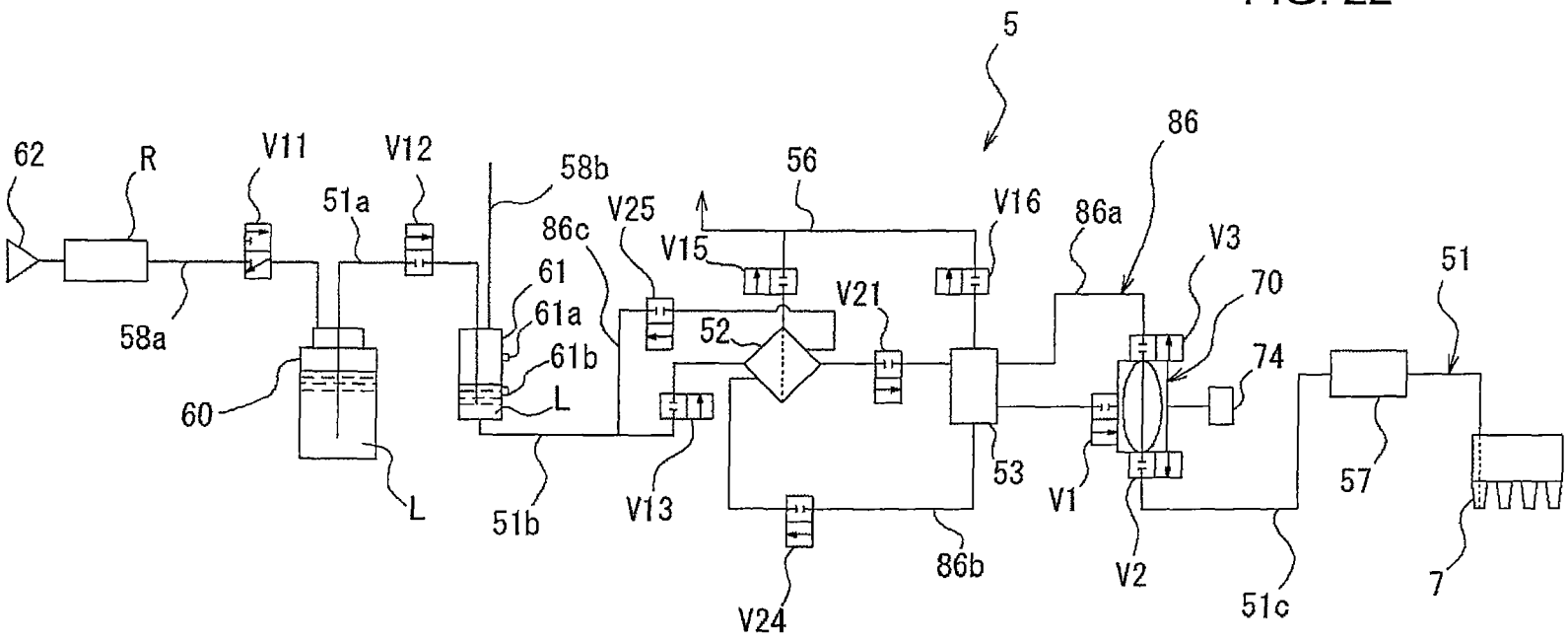
FIG. 22 is a cross-sectional view schematically showing a modified example of the liquid-processing apparatus according to the third embodiment.

In the modified example shown in FIG. 22, reverse-flow pipeline 86 of the third embodiment is formed with first main reverse-flow pipeline (86*a*) connecting the discharge side of pump 70 and trap tank 53, second main reverse-flow pipeline (86*b*) connecting trap tank 53 and the upstream side of filter 52, and secondary reverse-flow pipeline (86*c*) connecting the discharge side of filter 52 and second processing-liquid supply pipeline (51*b*) on the upstream side of filter 52. Here, first main reverse-flow pipeline (86*a*) and second main reverse-flow pipeline (86*b*) correspond to a main reverse-flow pipeline according to an embodiment of the present invention. Moreover, electromagnetic on/off valve (V24) is provided for second main reverse-flow pipeline (86*b*), and electromagnetic on/off valve (V25) is provided for secondary reverse-flow pipeline (86*c*). Those on/off valves (V24, V25) are set to be controllable by control signals from the above control device (not shown).

Figure 23:
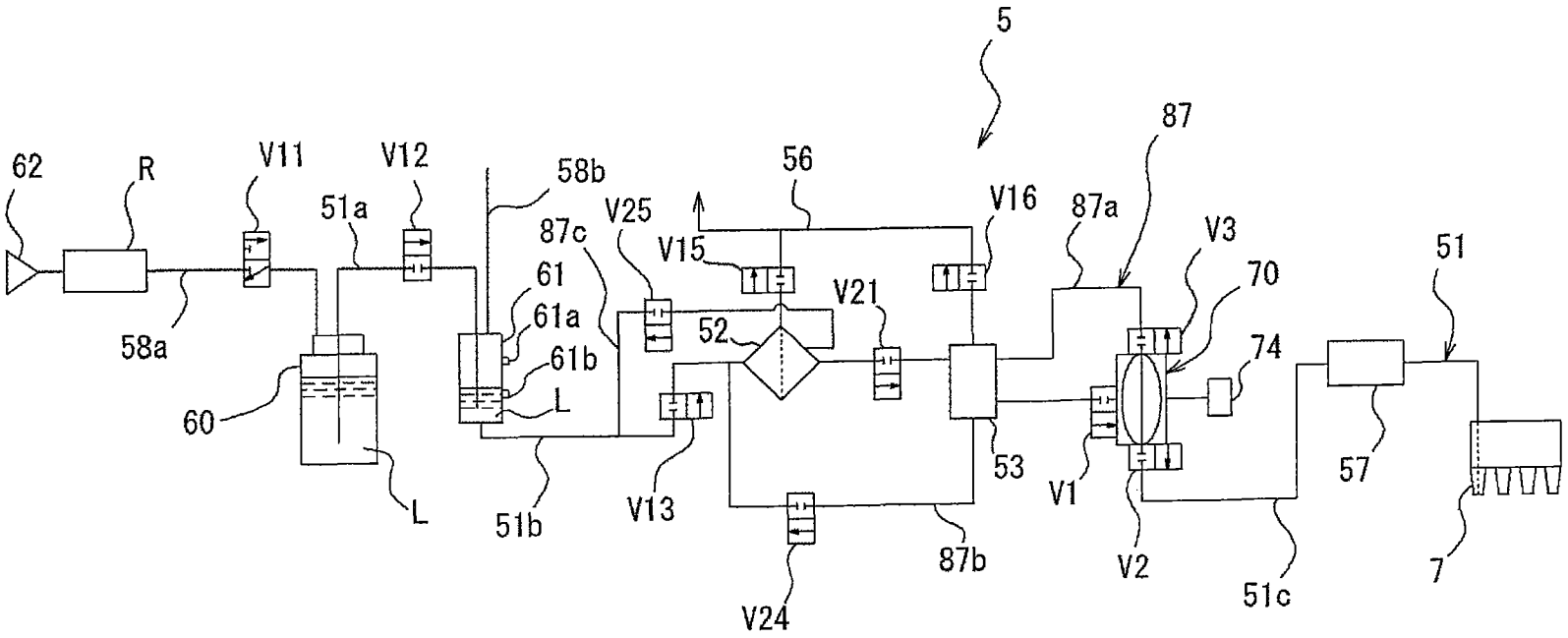
FIG. 23 is a cross-sectional view schematically showing another modified example of the liquid-processing apparatus according to the third embodiment.

In the modified example shown in FIG. 23, reverse-flow pipeline 87 of the third embodiment is formed with first main reverse-flow pipeline (87*a*) connecting the discharge side of pump 70 and trap tank 53, second main reverse-flow pipeline (87*b*) connecting trap tank 53 and second processing-liquid supply pipeline (51*b*) on the upstream side of filter 52, and secondary reverse-flow pipeline (87*c*) connecting the discharge side of filter 52 and second processing-liquid supply pipeline (51*b*) on the upstream side of filter 52. Here, first main reverse-flow pipeline (87*a*) and second main reverse-flow pipeline (87*b*) correspond to a main reverse-flow pipeline according to an embodiment of the present invention. Moreover, electromagnetic on/off valve (V24) is provided for second main reverse-flow pipeline (87*b*), and electromagnetic on/off valve (V25) is provided for secondary reverse-flow pipeline (87*c*). Those on/off valves (V24, V25) are set to be controllable by control signals from the above control device (not shown).

Figure 24:
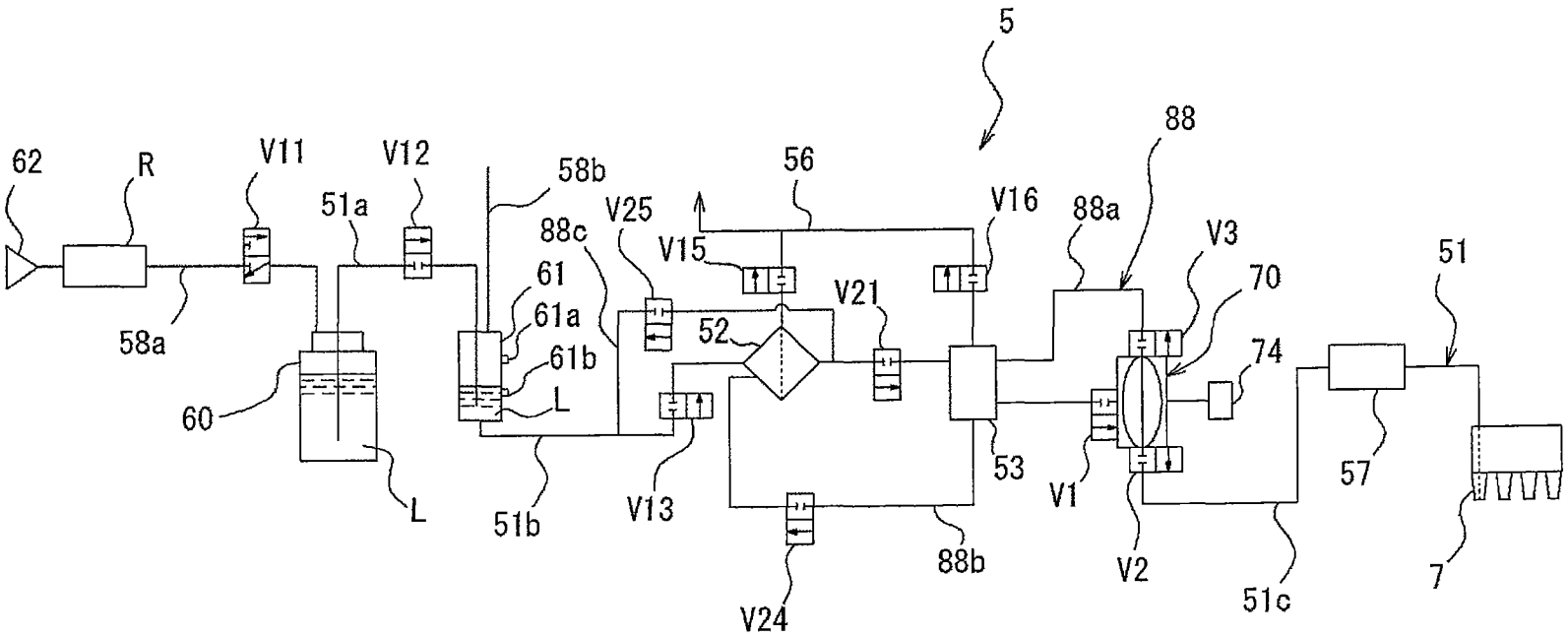
FIG. 24 is a cross-sectional view schematically showing yet another modified example of the liquid-processing apparatus according to the third embodiment.

In the modified example shown in FIG. 24, reverse-flow pipeline 88 of the third embodiment is formed with first main reverse-flow pipeline (88*a*) connecting the discharge side of pump 70 and trap tank 53, second main reverse-flow pipeline (88*b*) connecting trap tank 53 and the upstream side of filter 52, and secondary reverse-flow pipeline (88*c*) connecting second processing-liquid supply pipeline (51*b*) on the downstream side of filter 52 and second processing-liquid supply pipeline (51*b*) on the upstream side of filter 52. Here, first main reverse-flow pipeline (88*a*) and second main reverse-flow pipeline (88*b*) correspond to a main reverse-flow pipeline according to an embodiment of the present invention. Moreover, electromagnetic on/off valve (V24) is provided for second main reverse-flow pipeline (88*b*), and electromagnetic on/off valve (V25) is provided for secondary reverse-flow pipeline (88*c*). Those on/off valves (V24, V25) are set to be controllable by control signals from the above control device (not shown).

Figure 25:
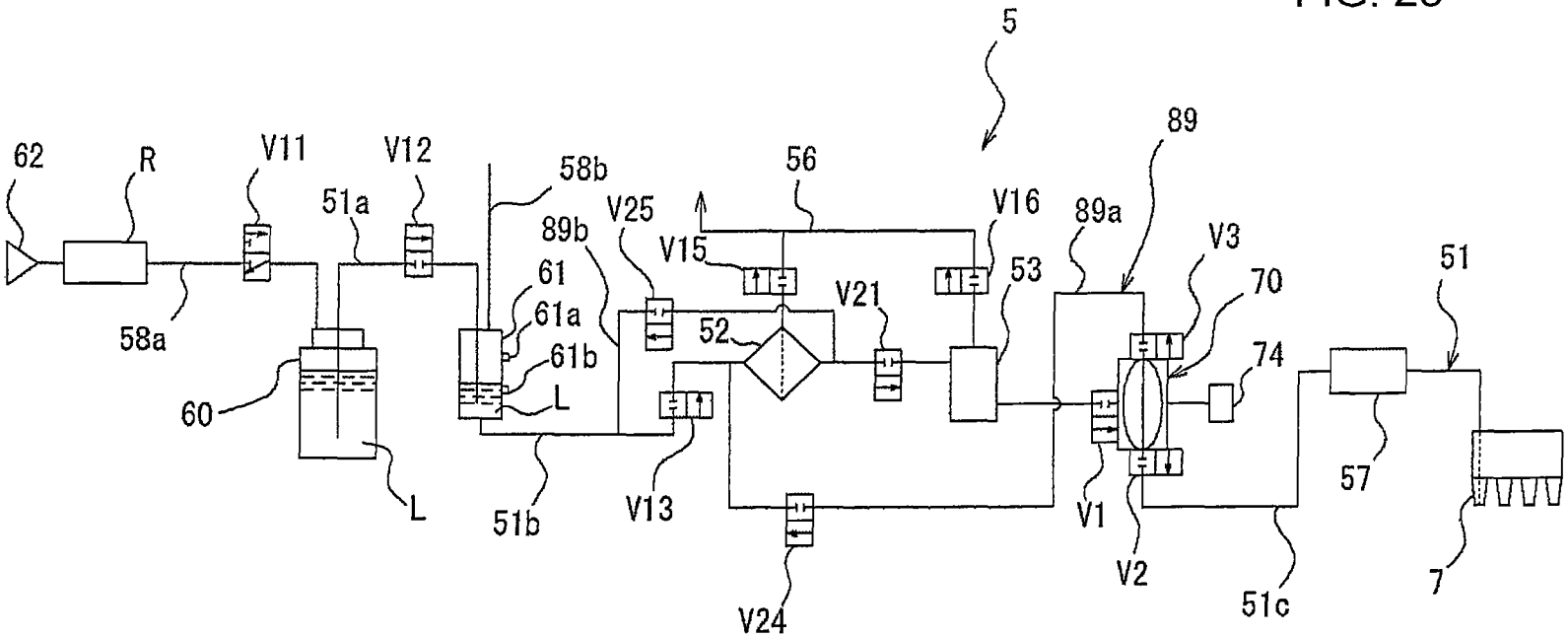
FIG. 25 is a cross-sectional view schematically showing yet another modified example of the liquid-processing apparatus according to the third embodiment.

In the modified example shown in FIG. 25, reverse-flow pipeline 89 of the third embodiment is formed with main reverse-flow pipeline (89*a*) connecting the discharge side of pump 70 and second processing-liquid supply pipeline (51*b*) on the upstream side of filter 52, and secondary reverse-flow pipeline (89*b*) connecting second processing-liquid supply pipeline (51*b*) on the downstream side of filter 52 and second processing-liquid supply pipeline (51*b*) on the upstream side of filter 52. Moreover, electromagnetic on/off valve (V24) is provided for main reverse-flow pipeline (89*a*). The on/off valve (V24) is set to be controllable by control signals from control device 101 (not shown).

In the operations of the modified examples of the third embodiment shown in FIG. 2224, step (S1) in FIG. 12 (suctioning resist liquid (L) to pump chamber 72 shown in FIG. 20) and step (S2) (discharging resist liquid (L) onto a wafer (W) shown in FIG. 20) are the same as each other, but step (S3) is different.

Namely, when the resist liquid (L) in diaphragm pump 70 is returned to second processing-liquid supply pipeline (51*b*) via reverse-flow pipeline 86, on/off valve (V2) is closed while on/off valves (V24, V25) are opened, and driver device 74 is driven so that a portion (four-fifths, for example) of the resist liquid (L) in diaphragm pump 70 flows into reverse-flow pipeline 86. Also, when the resist liquid (L) in diaphragm pump 70 is returned to second processing-liquid supply pipeline (51*b*) via reverse-flow pipelines (87, 88), on/off valve (V2) is closed while on/off valves (V24, V25) are opened, and driver device 74 is driven so that a portion (four-fifths, for example) of the resist liquid (L) in diaphragm pump 70 flows into reverse-flow pipelines (87, 88).

Moreover, in the operations in the modified example of the third embodiment shown in FIG. 25, steps (S1, S2) conducted in the third embodiment and shown in FIGS. 19 and 20 are the same, but step (S3) shown in FIG. 21 is different in that resist liquid (L) flowing in main reverse-flow pipeline (89*a*) passes through filter 52 without going through trap tank 53. Namely, in the example shown in FIG. 25, resist liquid (L) refilled from buffer tank 61 and the resist liquid (L) returning from pump 70 to the upstream side of filter 52 will not be combined in trap tank 53. Thus, resist liquid (L) is set to flow at a desired number of combinations.

In the modified examples of the third embodiment shown in FIG. 22~24, it is also an option for reverse-flow pipelines (86, 87, 88) to employ a structure that does not include trap tank 53 as shown in FIG. 25.

Accordingly, in the modified examples of the third embodiment as well, filtration efficiency is enhanced while throughput is secured to be the same level as that where resist liquid is not filtered or is filtered once by a filter device, the same as in the first and second embodiments. Thus, without significantly changing the apparatus, the filtration efficiency using one filter device is achieved to be the same level as using multiple filter devices, and throughput is prevented from decreasing.

Fourth Embodiment

Figure 26:
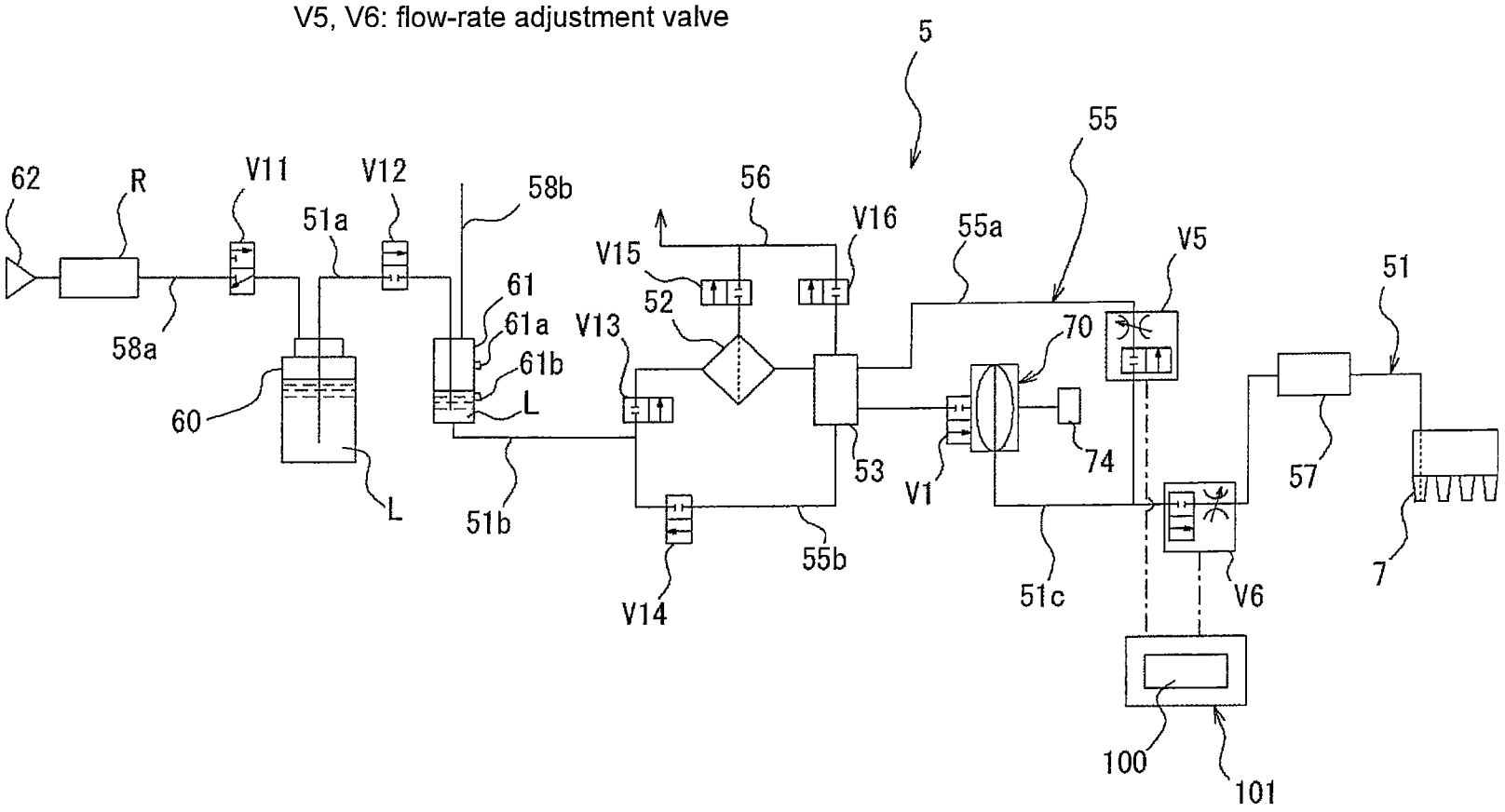
FIG. 26 is a cross-sectional view schematically showing a liquid-processing apparatus according to a fourth embodiment of the present invention.

Based on FIG. 26, a liquid-processing apparatus according to a fourth embodiment of the present invention is described below. In the fourth embodiment, the same reference numerals are applied to the same structure as that in the first embodiment, and their descriptions will be omitted here.

In the fourth embodiment, a non-return valve (not shown) is provided instead of on/off valve (V2) at the junction between diaphragm pump 70 and third processing-liquid supply pipeline (51*c*), and flow-rate adjustment valve (V6) is provided for third processing-liquid supply pipeline (51*c*) on the downstream side of the junction of third processing-liquid supply pipeline (51*c*) and reverse-flow pipeline 55. Flow-rate adjustment valve (V6) is an on/off valve capable of adjusting the flow rate of resist liquid (L) discharged to discharge nozzle 7.

In addition, instead of on/off valve (V3) provided at the junction of diaphragm pump 70 and reverse-flow pipeline 55, flow-rate adjustment valve (V5) is provided for first reverse-flow pipeline (55*a*) positioned between pump 70 and trap tank 53. Flow-rate adjustment valve (V5) is an on/off valve capable of adjusting the flow rate of resist liquid (L) returning to second processing-liquid supply pipeline (51*b*). Flow-rate adjustment valves (V5, V6) are controlled by control device 101.

Moreover, reverse-flow pipeline 55 of the fourth embodiment is formed with first reverse-flow pipeline (55*a*) connecting third processing-liquid supply pipeline (51*c*) and trap tank 53, and second reverse-flow pipeline (55*b*) connecting trap tank 53 and second processing-liquid supply pipeline (51*b*) on the upstream side of filter 52.

In the operations of the fourth embodiment, among the steps conducted in the first embodiment as shown in FIG. 12, step (S1) (suctioning resist liquid (L) to pump chamber 72) is the same, but step (S2) (discharging resist liquid (L) onto a wafer (W)) and step (S3) (returning resist liquid (L) to reverse-flow pipeline 55) are different. When resist liquid (L) in diaphragm pump 70 is discharged onto a wafer (W) through discharge nozzle 7, on/off valve (V1) and flow-rate adjustment valve (V5) are closed while flow-rate adjustment valve (V6) is opened, and driver device 74 is driven. Accordingly, a portion (one-fifth, for example) of the resist liquid (L) in diaphragm pump 70 is discharged. At that time, the flow rate of resist liquid (L) flowing through third processing-liquid supply pipeline (51*c*) is adjusted by supply-discharge switching valve (V4).

Next, when resist liquid (L) in diaphragm pump 70 is returned to second processing-liquid supply pipeline (51*b*) via reverse-flow pipeline 55, flow-rate adjustment valve (V6) is closed while flow-rate adjustment valve (V5) is opened, and driver device 74 is driven. Accordingly, a portion (four-fifths, for example) of the resist liquid (L) in diaphragm pump 70 flows into reverse-flow pipeline 55. At that time, the flow rate of resist liquid (L) returning through second processing-liquid supply pipeline (51*b*) is adjusted by flow-rate adjustment valve (V5).

Accordingly, the same as in the first to third embodiments, filtration efficiency is enhanced while throughput is secured to be the same level as that where resist liquid is not filtered or is filtered once by a filter device. Thus, without significantly changing the apparatus, filtration efficiency using one filter device is achieved to be the same level as that using multiple filter devices, and throughput is prevented from decreasing.

In the fourth embodiment, second processing-liquid supply pipeline (51*b*), trap tank 53 provided for drain pipeline 56, filter 52 and on/off valves (V13~V16) are set in the same structure as in the first embodiment. However, it is an option for the fourth embodiment to set second processing-liquid supply pipeline (51*b*), drain pipeline 56, trap tank 53, filter 52 and on/off valves (V13~V16) in the same structure as that in the second embodiment or the third embodiment. In such a structure as well, significant modification to the apparatus is not required, and filtration efficiency using one filter device is achieved to be the same level as that using multiple filter devices, and throughput is prevented from decreasing.

In the above described first through fourth embodiments, it is an option not to provide trap tank 53 on the upstream side of filter 52. Alternatively, another trap tank 53 may be provided between filter 52 and pump 70 in addition to or instead of the first trap tank 53. Moreover, instead of positioning pump 70 on the downstream side of filter 52, pump 70 may be provided on the upstream side of filter 52. Namely, resist liquid (L) may be set to pass through filter 52 using the feeding force of pump 70. Also, when pump 70 is positioned on the upstream side of filter 52, trap tank 53 may be arranged at least either between processing-liquid vessel 60 and pump 70, between pump 70 and filter 52, or between filter 52 and discharge nozzle 7.

Fifth Embodiment

Figure 27:
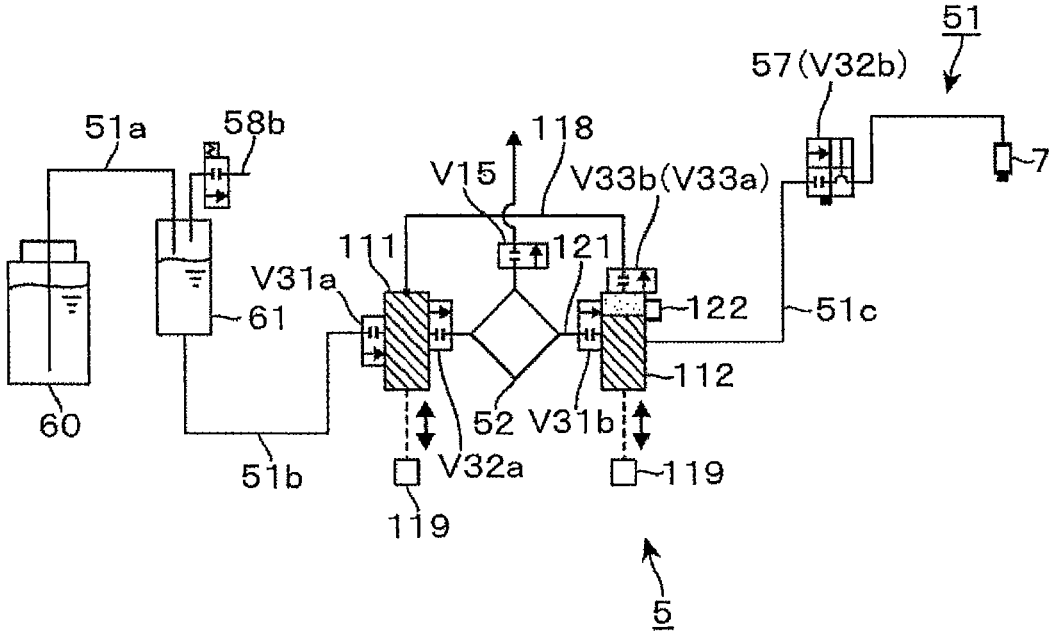
FIG. 27 is a cross-sectional view schematically showing a liquid-processing apparatus according to a fifth embodiment of the present invention.
Figure 28:
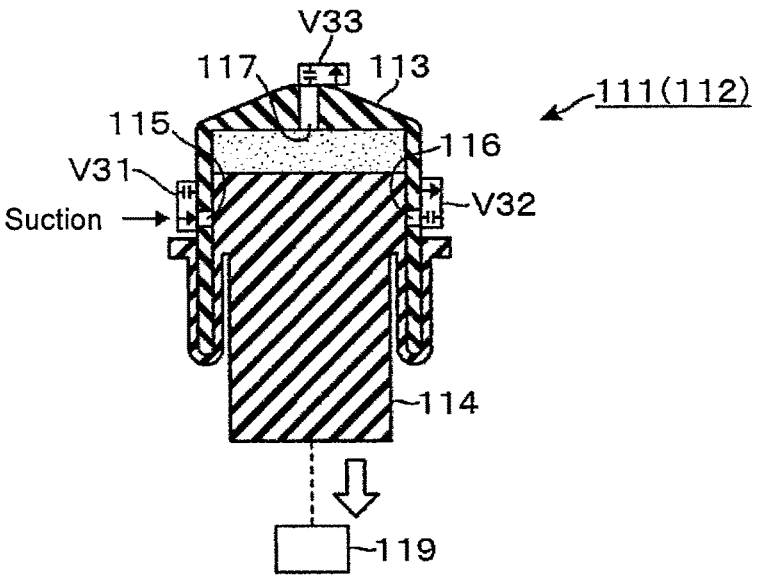
FIG. 28 is a cross-sectional view schematically showing an example of a pump device used in the fifth embodiment.

Next, a fifth embodiment of the present invention is described with reference to FIG. 27~33. In the fifth embodiment, when conducting combined filtration as described in the first embodiment, supply pump 111 and discharge pump 112 are respectively provided for second processing-liquid supply pipeline (51*b*) on the upstream side of filter 52 and third processing-liquid supply pipeline (51*c*) on the downstream side of filter 52. Pumps (111, 112) are, for example, diaphragm pumps as shown in FIG. 28. More specifically, pumps (111, 112) are each structured with external member 113 in substantially a cylindrical shape with its one side being open (the lower side in FIG. 28) along with cylindrical advancing/retreating member 114 inserted into external member 113 in such a way that it is capable of advancing and retreating from the one side toward the other side. In FIG. 27, the same reference numeral is applied to the same member already described earlier and its description is omitted here.

Figure 29:
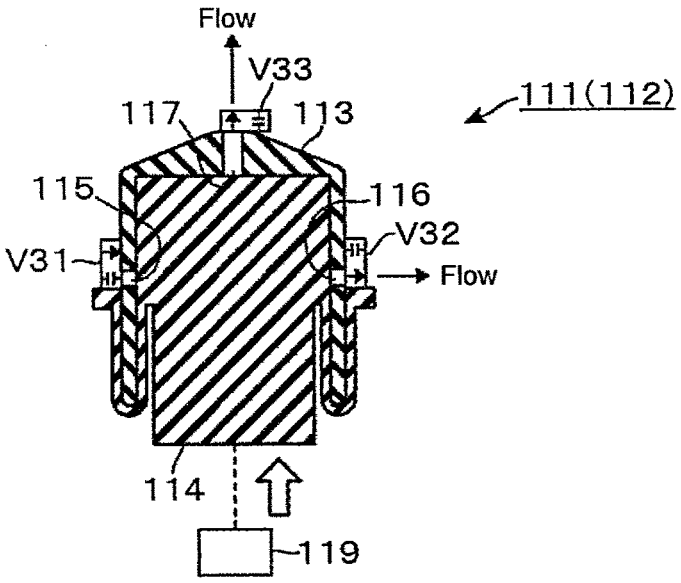
FIG. 29 is a cross-sectional view schematically showing yet another example of a pump device used in the fifth embodiment.

On the side periphery of external member 113, suction port 115, which suctions up resist liquid (L) from the processing vessel 60 side, and supply port 116, which supplies resist liquid (L) to the wafer side, are positioned to face each other. In addition, at the tip portion of external member 113 facing advancing/retreating member 114, return port 117 is formed to return resist liquid (L) to the filter 52 side, and return port 117 is the opening end of reverse-flow channel 118 described later. Then, on/off valves (V31, V32, V33) are respectively provided for flow channels extending from suction port 115, supply port 116 and return port 117 (second processing-liquid supply pipeline (51*b*), third processing-liquid supply pipeline (51*c*), and reverse-flow channel 118). In FIGS. 28 and 29, positions of on/off valves (V31~V33) are intentionally shown closer to pumps (111, 112).

Advancing/retreating member 114 is equipped with driver device 119, such as a stepping motor or a servomotor, for example. Advancing/retreating member 114 is structured to be capable of advancing and retreating while the periphery at its edge keeps in tight contact with the opening end of external member 113. Thus, when on/off valve (V31) is opened and on/off valves (V32, V33) are closed, while advancing/retreating member 114 retreats in a direction to be pulled out of external member 113, resist liquid (L) is drawn into the internal region of external member 113 through suction port 115 from second processing-liquid supply pipeline (51*b*), as shown in FIG. 28.

On the other hand, when on/off valve (V31) is closed and on/off valve (V32) or (V33) is opened, while advancing/retreating member 114 advances in a direction to be pushed into external member 113, resist liquid (L) is discharged toward third processing-liquid supply pipeline (51*c*) (reverse-flow channel 118) via on/off valve (V32) (on/off valve (V33)). The liquid supply amount (liquid storage amount) in each of pumps (111, 112) is 30 mL, for example. In the following, operations to push advancing/retreating member 114 into external member 113 and to pull out advancing/retreating member 114 from external member 113 are respectively described as "advance advancing/retreating member 114" and "retreat advancing/retreating member 114."

Next, description of the structure of liquid-supply apparatus 5 having pumps (111, 112) is resumed. As shown in FIG. 27, connection channel 121 with filter 52 installed therein is positioned between pumps (111, 112). In connection channel 121, the edge of its upstream-side opening corresponds to supply port 116 of supply pump 111 and the edge of its downstream-side opening corresponds to suction port 115 of discharge pump 112. Also, reverse-flow channel 118, different from connection channel 121, is provided between pumps (111, 112), and return ports (117, 117) of pumps (111, 112) are connected to each other by reverse-flow channel 118.

Here, when on/off valves (V31~V33) of supply pump 111 and on/off valves (V31~V33) of discharge pump 112 are each referred to with an alphabetical suffix of "a" or "b," on/off valve (V33*a*) of supply pump 111 is shared with discharge pump 112 as its on/off valve (V33*b*), as shown in FIG. 27. In addition, on/off valve (V32*b*) of discharge pump 112 is shared to function as supply control valve 57. Reference numeral 122 in FIG. 27 indicates a pressure gauge to measure the pressure of resist liquid (L) in discharge pump 112.

Next, specific operations of combined filtration using pumps (111, 112) are described. At an initial stage, advancing/retreating member 114 is pushed deep into external member 113 of supply pump 111 so that the stored amount of resist liquid (L) is zero as shown in FIG. 27. Meanwhile, in discharge pump 112, advancing/retreating member 114 is pulled out from its position deep inside, and 1 mL, for example, of resist liquid (L) is stored. In addition, on/off valves (V31~V33) including supply control valve 57 are each closed.

Figure 30:
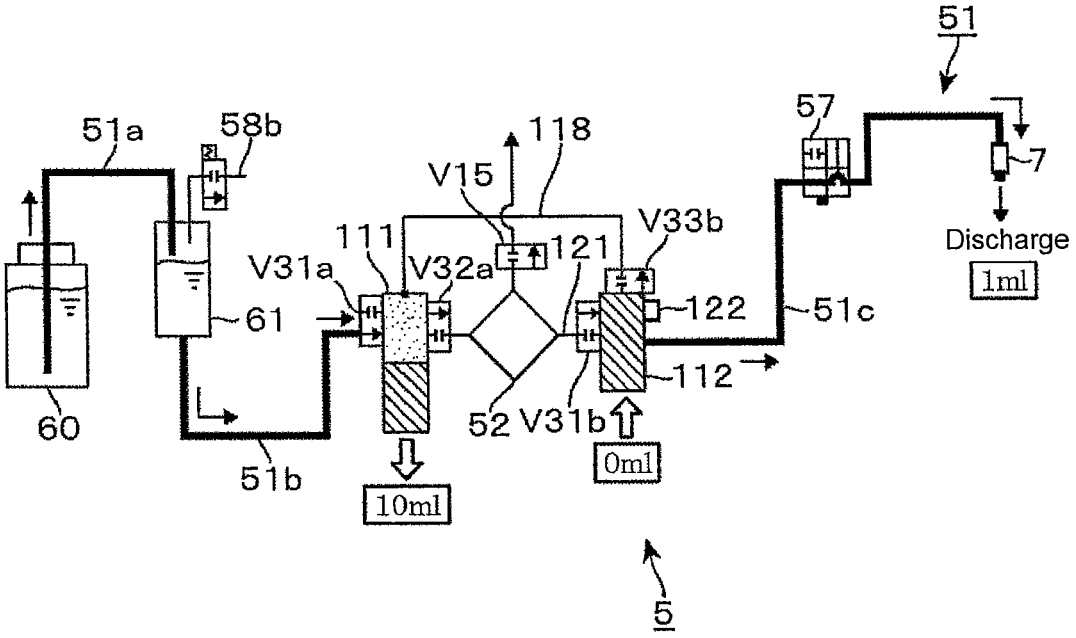
FIG. 30 is a cross-sectional view schematically showing a processing-liquid discharge operation in the liquid-processing apparatus according to the fifth embodiment.

Following such an initial stage, resist liquid (L) is discharged onto a wafer and resist liquid (L) is filled into supply pump 111. More specifically, as shown in FIG. 30, when supply control valve 57 is opened and advancing/retreating member 114 of discharge pump 112 advances, resist liquid (L) stored in discharge pump 112 is discharged onto a wafer via third processing-liquid supply pipeline (51*c*) and discharge nozzle 7. On the other hand, when on/off valve (V31*a*) of supply pump 111 is opened and advancing/retreating member 114 of supply pump 111 retreats, resist liquid (L) is drawn from the processing-liquid vessel 60 side (from buffer tank 61, in particular), and 10 mL, for example, of resist liquid (L) will be stored in supply pump 111. Such a discharge operation and refill operation are conducted simultaneously.

Here, "simultaneously" includes synchronizing the starting time and finishing time of pumps (111, 112), as well as having one pump 111 (112) start its operation and before it finishes, having the other pump 112 (111) be in operation, namely, a situation during which the discharge operation of resist liquid (L) and the refill operation of resist liquid (L) overlap. In FIG. 30, the stored amounts of resist liquid (L) are shown under pumps (111, 112) respectively. The same applies in FIG. 31~33. FIG. 30~33 are views schematically showing the structure of each apparatus.

Figure 31:
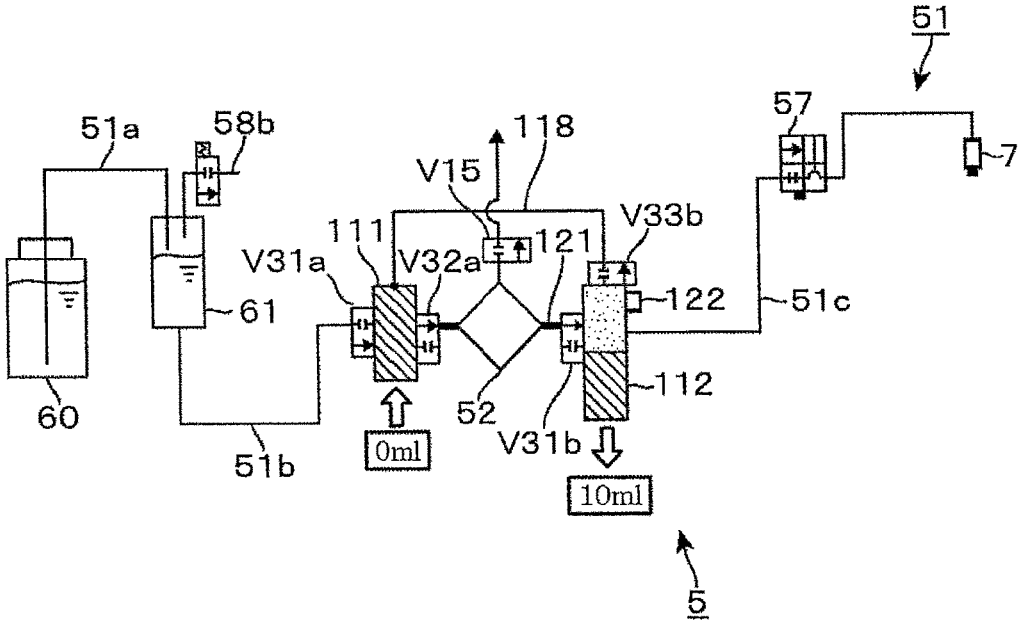
FIG. 31 is a cross-sectional view schematically showing a processing-liquid supply operation in the liquid-processing apparatus of the fifth embodiment.

Next, as shown in FIG. 31, on/off valve (V31*a*) is closed and on/off valve (V32*a*) is opened in supply pump 111. On/off valve (V31*b*) is opened and supply control valve 57 is closed in discharge pump 112. Then, when advancing/retreating member 114 of supply pump 111 advances, and advancing/retreating member 114 of discharge pump 112 retreats, resist liquid (L) in supply pump 111 passes through filter 52 for removal of contaminants and bubbles and flows into discharge pump 112. At that time, to remove bubbles remaining in filter 52 (to vent) following the filtration of resist liquid (L), approximately 0.5~1 mL of resist liquid (L) is set aside to remain in supply pump 111. In FIG. 31, for the sake of simplification, the amount of resist liquid (L) in supply pump 111 is shown as 0 mL.

Figure 32:
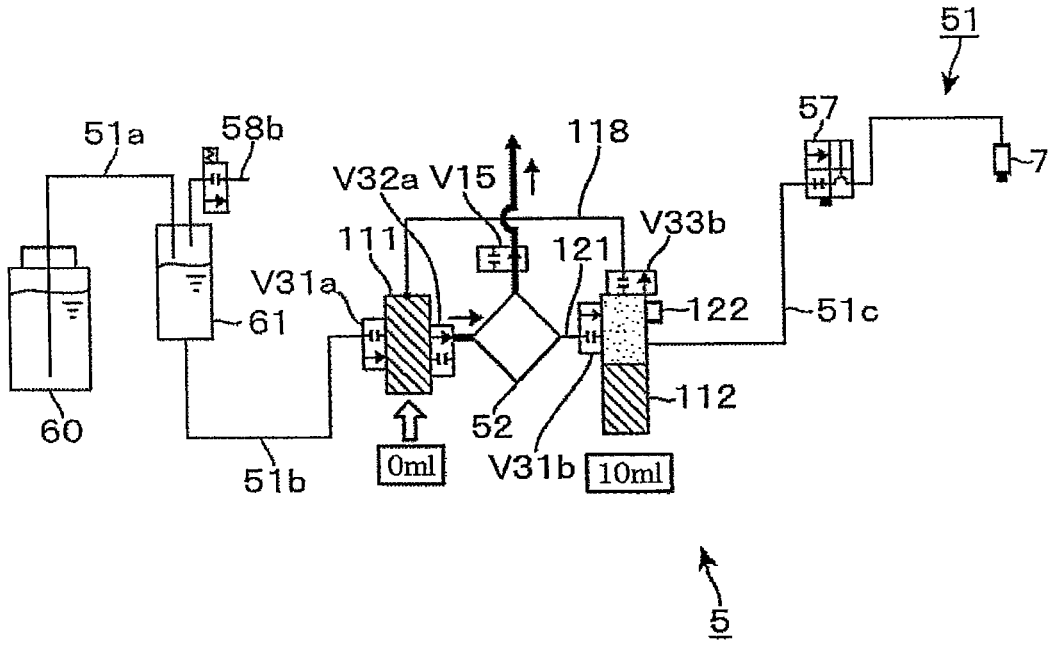
FIG. 32 is a cross-sectional view schematically showing a processing-liquid supply operation in the liquid-processing apparatus of the fifth embodiment.

To remove bubbles, on/off valve (V15) at the top portion/of filter 52 is opened and on/off valve (V31*b*) of discharge pump 112 is closed as shown in FIG. 32. Then, when advancing/retreating member 114 of supply pump 111 slightly advances (so that approximately 0.1~1 mL of resist liquid (L) will be discharged), bubbles remaining in filter 52 are discharged along with resist liquid (L).

Figure 33:
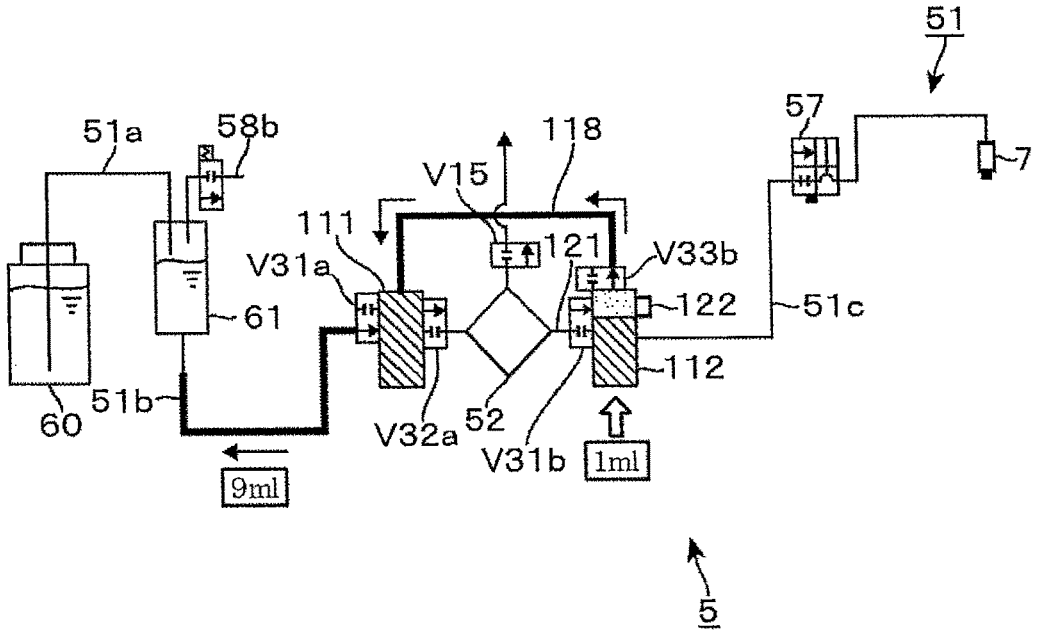
FIG. 33 is a cross-sectional view schematically showing a processing-liquid circulation operation in the liquid-processing apparatus of the fifth embodiment.

Next, as shown in FIG. 33, on/off valve (V31*a*) is opened and on/off valve (V32*a*) is closed in supply pump 111. In addition, on/off valve (V33*b*) is opened and on/off valve (V15) is closed in discharge pump 112. Moreover, if the aforementioned bubble-removal process at filter 52 was not conducted, on/off valve (V31*b*) of discharge pump 112 is closed. Then, advancing/retreating member 114 of discharge pump 112 advances, and resist liquid (L) in discharge pump 112 flows to supply pump 111 via reverse-flow channel 118. Meanwhile, advancing/retreating member 114 of supply pump 111 is in a completely advanced position.

As a result, resist liquid (L) in reverse-flow channel 118 flows through second processing-liquid supply pipeline (51*b*), which is positioned farther on the upstream side than supply pump 111, toward buffer tank 61. Until the excess amount (9 mL) that is beyond the required amount for a subsequent wafer process (1 mL) is discharged from discharge pump 112, or any amount (1 mL~9 mL) of resist liquid (L) is discharged from discharge pump 112, advancing/retreating member 114 keeps advancing in discharge pump 112.

Here, the capacity obtained by adding the capacity of the portion in reverse-flow channel 118 where resist liquid (L) flows and the capacity of the portion in second processing-liquid supply pipeline (51*b*) where resist liquid (L) flows is set greater than the amount of resist liquid (L) to be returned from discharge pump 112 toward the supply pump 111 side. Therefore, resist liquid (L) returning toward the buffer tank 61 side caused by the advancing operation of advancing/retreating member 114 of discharge pump 112 does not reach buffer tank 61 as shown in FIG. 33. Accordingly, the resist liquid (L) that passed through filter 52 once does not mix with the resist liquid (L) stored in buffer tank 61.

FIG. 33 shows a view of the initial stage described with reference to FIG. 27. Thus, when resist liquid (L) is refilled in supply pump 111, the resist liquid (L), returned toward the buffer tank 61 side through second processing-liquid supply pipeline (51*b*) after passing through filter 52 once, passes through filter 52 again. Therefore, the combined filtration described in the first embodiment will be performed. After that, a series of procedures is repeated, namely, discharging resist liquid (L) onto a wafer, returning resist liquid (L) in discharge pump 112 to the upstream side of filter 52, drawing resist liquid (L) into supply pump 111, and flowing resist liquid (L) through filter 52.

As described above, when combined filtration is performed by positioning pumps (111, 112) on the upstream side and downstream side of filter 52 respectively, the following effects are achieved in addition to the same effects as in the first embodiment. Namely, when resist liquid (L) passes through filter 52 and flows toward the discharge pump 112 side, discharge pressure from supply pump 111 is available. Therefore, since connection channel 121 is kept at positive pressure, bubbles are suppressed from going into connection channel 121, and trap tank 53 described in the first embodiment can thereby be omitted. In addition, when resist liquid (L) passes through filter 52, in addition to the pressure to pump out resist liquid (L) from supply pump 111, the pressure in discharge pump 112 to suction resist liquid (L) is also available. Therefore, it is easier to adjust the pressure in filter 52.

Moreover, compared with the structure shown in FIG. 1, for example, since the piping structure can be simplified, an increase in the cost of running the apparatus and a loss in pressure in pipelines are reduced. In addition, since discharging resist liquid (L) onto a wafer and suctioning resist liquid (L) from buffer tank 61 can be conducted simultaneously, a discharge process of resist liquid (L) for a subsequent wafer is conducted promptly.

Figure 34:
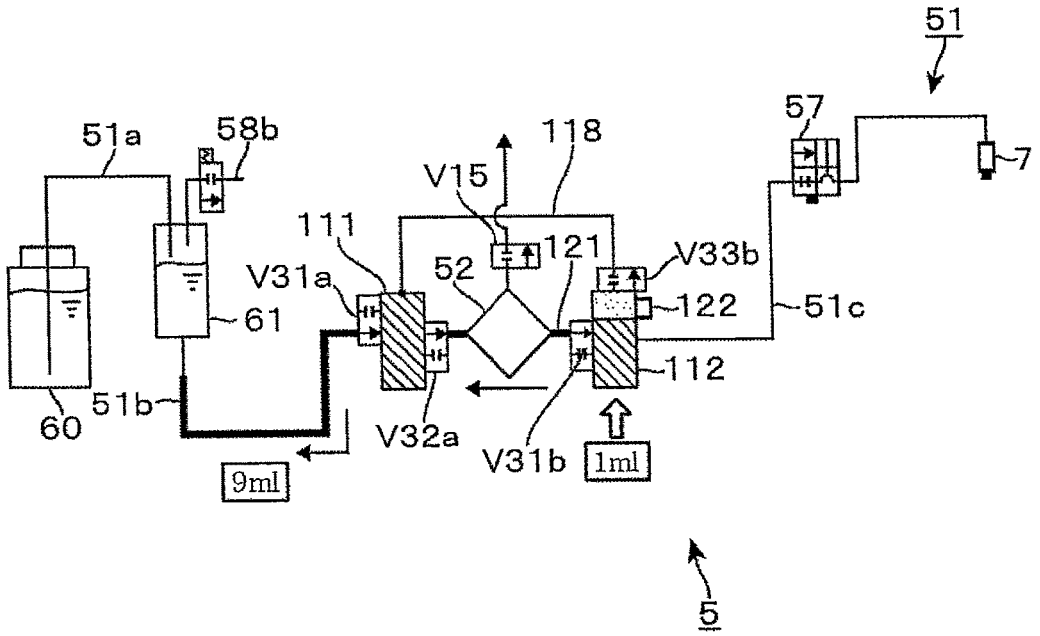
FIG. 34 is a cross-sectional view schematically showing a modified example of the liquid-processing apparatus according to the fifth embodiment.

FIG. 34 shows another example of the fifth embodiment. When the resist liquid (L) that has already passed through filter 52 passes through filter 52 again, the flow of resist liquid (L) is reversed in connection channel 121, the same as in the aforementioned second embodiment. In such a case, when resist liquid (L) passes through filter 52 again, on/off valves (V31*a*, V32*a*) of supply pump 111 along with on/off valve (31*b*) of discharge pump 112 are each opened, and on/off valve (V33*b*) of reverse-flow channel 118 is closed. Thus, when resist liquid (L) returns to the upstream side of filter 52, it passes through filter 52. Accordingly, the effects of combined double-circulatory filtration shown in formula (2) above are achieved.

Sixth Embodiment

Figure 35:
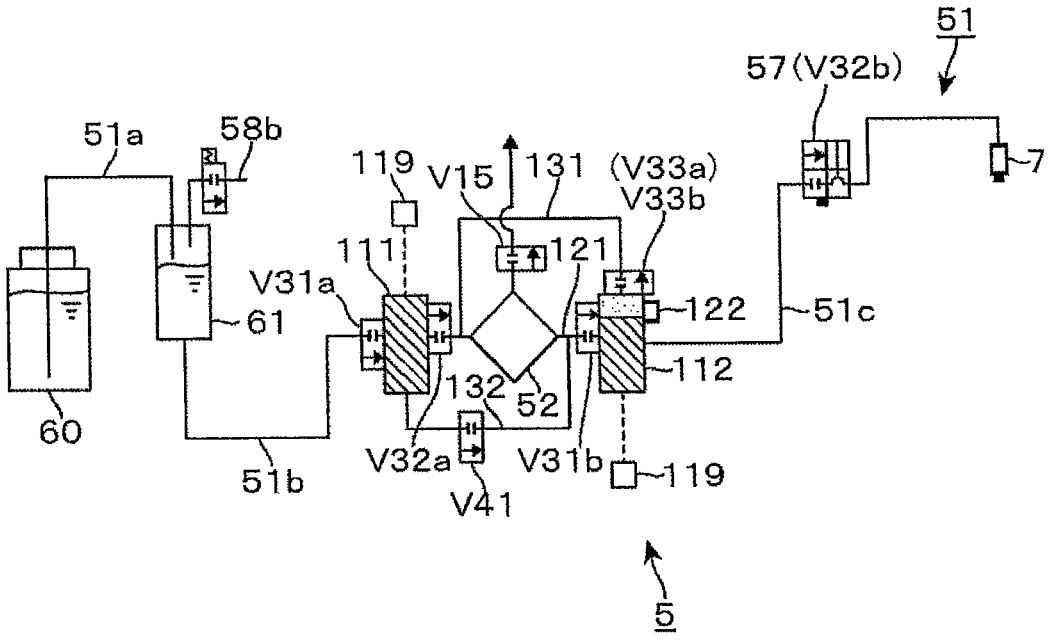
FIG. 35 is a cross-sectional view schematically showing a liquid-processing apparatus according to a sixth embodiment of the present invention.

When the aforementioned combined double-circulatory filtration is conducted in a sixth embodiment, third reverse-flow channel 131 and fourth reverse-flow channel 132 are provided to replace reverse-flow channel 118 shown in FIG. 27. More specifically, as shown in FIG. 35, one end of third reverse-flow channel 131 is connected to return port 117 of discharge pump 112 and the other end is connected to second processing-liquid supply pipeline (51*b*) positioned between filter 52 and supply pump 111. Also, one end of fourth reverse-flow channel 132 is connected to connection channel 121 between filter 52 and discharge pump 112 and the other end is connected to return port 117 of supply pump 111. On/off valve (V41) is provided for fourth reverse-flow channel 132. In FIG. 35, supply pump 111 is shown upside down for the sake of drawing convenience. Subsequent views in FIG. 36~40 are the same.

Figure 36:
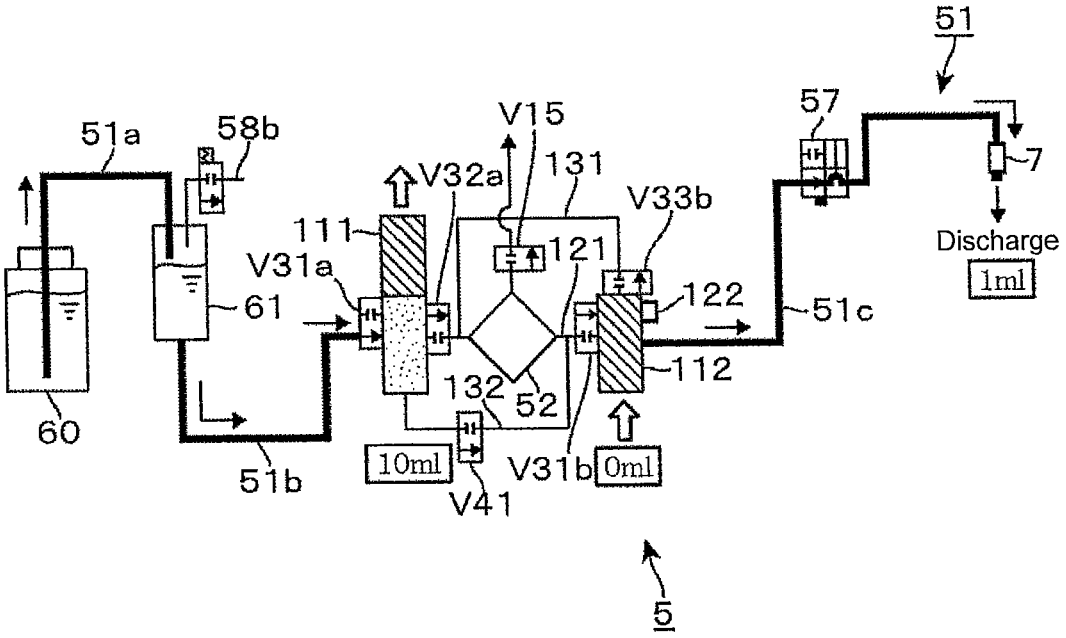
FIG. 36 is a cross-sectional view schematically showing a processing-liquid discharge operation in the liquid-processing apparatus according to the sixth embodiment.
Figure 37:
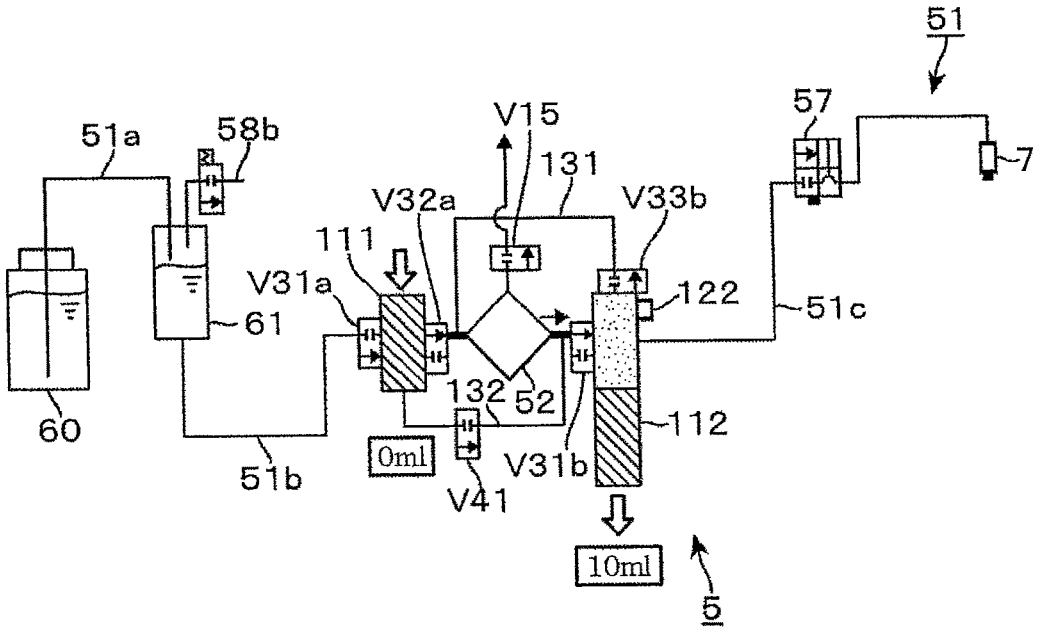
FIG. 37 is a cross-sectional view schematically showing a processing-liquid supply operation in the liquid-processing apparatus of the sixth embodiment.

In the initial stage of the above structure, the amount of resist liquid (L) stored in supply pump 111 is set at zero, and the amount of resist liquid (L) in discharge pump 112 is set at 1 mL, for example, as shown in FIG. 35. Next, as shown in FIG. 36, resist liquid (L) is discharged onto a wafer from discharge pump 112 and 10 mL, for example, of resist liquid (L) is refilled to supply pump 111. Then, as shown in FIG. 37, when resist liquid (L) flows from supply pump 111 to discharge pump 112, filter 52 removes contaminants and bubbles in resist liquid (L). During that time, on/off valve (V32*b*) of discharge pump 112 and on/off valve (V41) of fourth reverse-flow channel 132 are each closed. Since on/off operations of on/off valves (V31~V33) and supply control valve 57 in FIGS. 36 and 37 are each the same as in the aforementioned fifth embodiment, their descriptions are omitted here.

Figure 38:
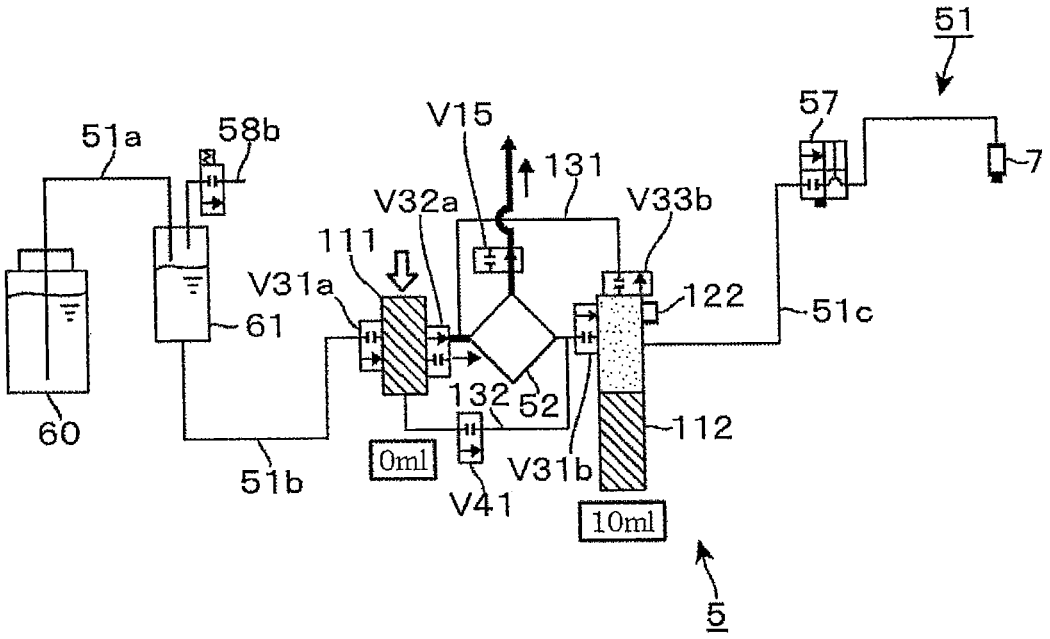
FIG. 38 is a cross-sectional view schematically showing a processing-liquid supply operation in the liquid-processing apparatus of the sixth embodiment.

After that, to remove bubbles remaining, for example, in filter 52, the small amount of resist liquid (L) left in supply pump 111 is drained through on/off valve (V15) at the upper portion/of filter 52 as shown in FIG. 38. In FIG. 37, for the sake of simplification, the amount of resist liquid (L) remaining in supply pump 111 is shown as 0 mL.

Figure 39:
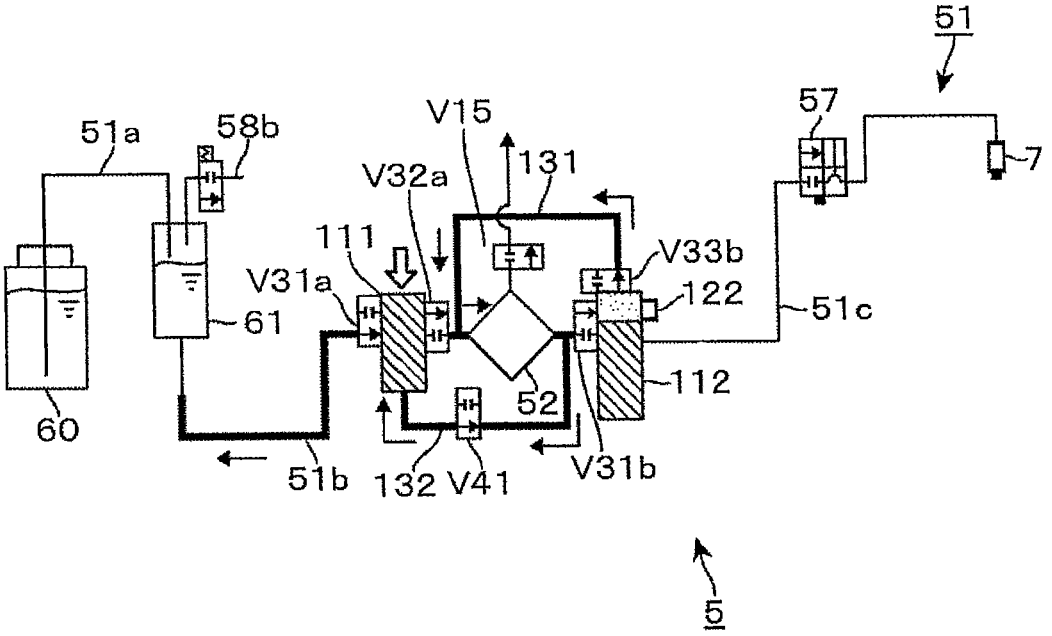
FIG. 39 is a cross-sectional view schematically showing a processing-liquid circulation operation in the liquid-processing apparatus of the sixth embodiment.

When resist liquid (L) in discharge pump 112 is returned to the upstream side of filter 52, on/off valve (V31*b*) is closed and on/off valve (V33*b*) is opened at discharge pump 112 as shown in FIG. 39. In addition, on/off valve (V31*a*) is opened and on/off valve (V32*a*) is closed at supply pump 111. Moreover, on/off valve (V41) is opened in fourth reverse-flow channel 132. Then, when advancing/retreating member 114 of discharge pump 112 advances, resist liquid (L) in discharge pump 112 flows through filter 52 via third reverse-flow channel 131, and then reaches the upstream side of supply pump 111 via fourth reverse-flow channel 132. In this example as well, the resist liquid (L) returning from discharge pump 112 to the upstream side of supply pump 111 will not reach buffer tank 61.

In the above sixth embodiment, the same effects as in the fifth embodiment are achieved in addition to the effects of combined double-circulatory filtration described in the second embodiment.

Figure 40:
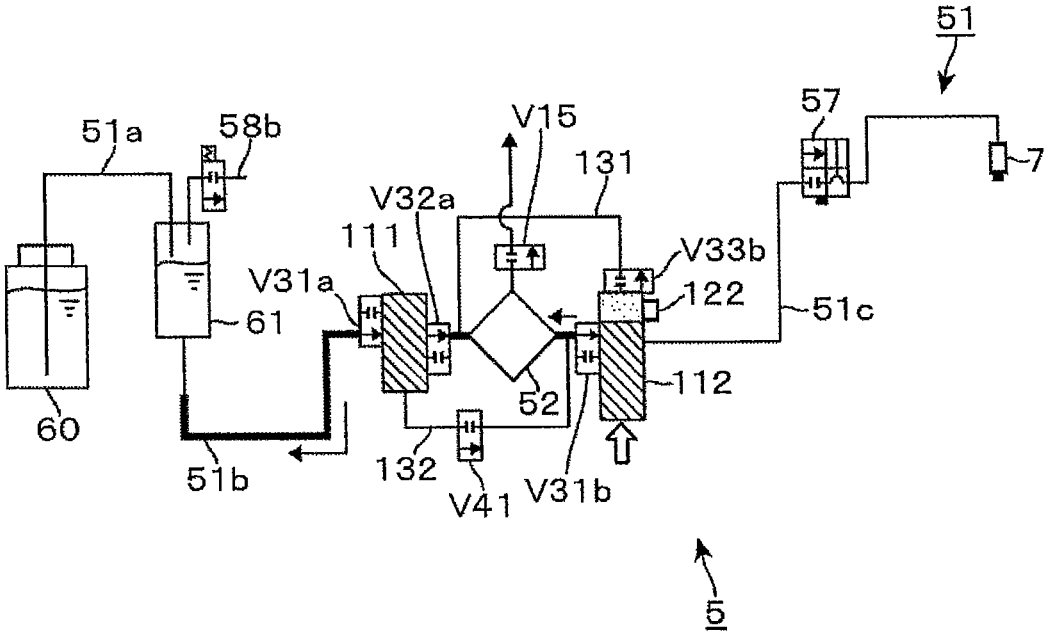
FIG. 40 is a cross-sectional view schematically showing a modified example of the liquid-processing apparatus according to the sixth embodiment.

FIG. 40 shows a modified example of the sixth embodiment. When combined double-circulatory filtration is performed using the structure having additional reverse-flow channels (131, 132), on/off valves (V31~V33, V41) are set in such a way that the flow of resist liquid (L) will be reversed in connection channel 121. Namely, on/off valve (V31*b*) is opened and on/off valve (V33*b*) is closed at discharge pump 112. In addition, on/off valves (V31*a*, V32*a*) are each opened at supply pump 111, and on/off valve (V41) of fourth reverse-flow channel 132 is closed. In such an example as well, the same effects of the sixth embodiment are achieved.

Seventh Embodiment

Figure 41:
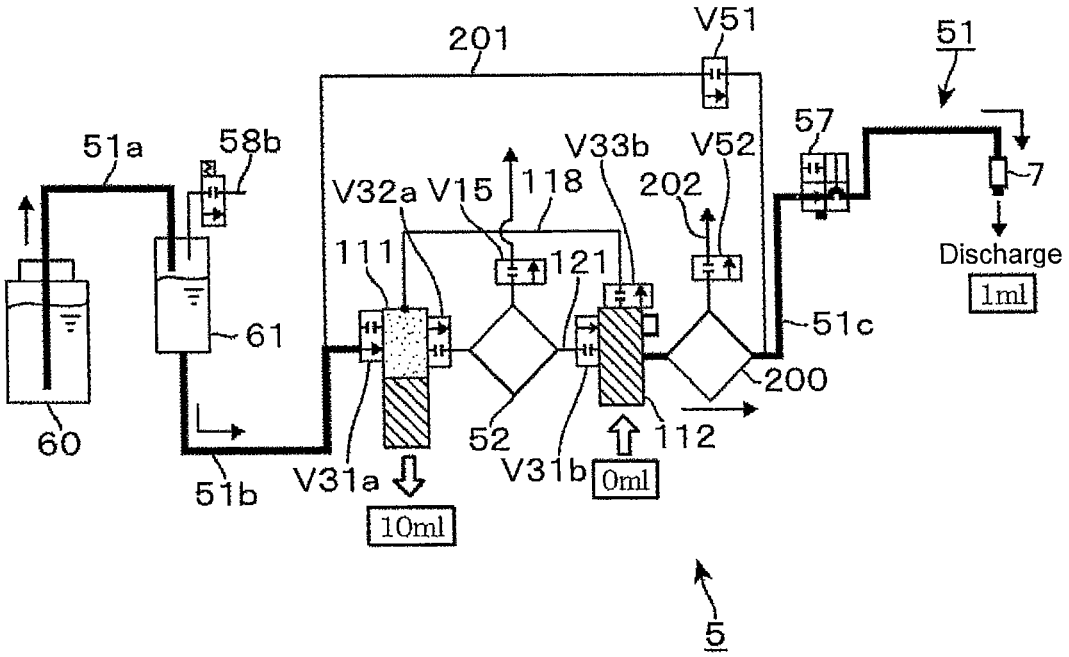
FIG. 41 is a cross-sectional view schematically showing a liquid-processing apparatus according to a seventh embodiment of the present invention.

In a seventh embodiment, another filter 200 separate from the aforementioned filter 52 is further provided on the downstream side of discharge pump 112 as shown in FIG. 41. An end of reverse-flow channel 201 is connected to third processing-liquid supply pipeline (51*c*) positioned between filter 200 and supply control valve 57, and the other end of reverse-flow channel 201 is connected via on/off valve (V51) to second processing-liquid supply pipeline (51*b*) between buffer tank 61 and supply pump 111. In FIG. 41, reference numeral 202 indicates a vent pipe to exhaust bubbles from filter 200, and (V52) indicates an on/off valve provided in vent pipe 202.

FIG. 41 is a view showing how resist liquid (L) is discharged from discharge nozzle 7, and how resist liquid (L) is refilled into supply pump 111 from buffer tank 61 in the seventh embodiment. Namely, the amount of resist liquid (L) stored in supply pump 111 increases from 0 mL to 10 mL, for example. Meanwhile, the amount of resist liquid (L) stored in discharge pump 112 decreases from 1 mL to 0 mL, for example, and that amount of resist liquid (L) passes through filter 200 and is discharged from discharge nozzle 7. During that time, on/off valves (V51, V52) are each closed. Regarding operations conducted subsequent to those for discharging resist liquid (L), namely, an operation for passing resist liquid (L) through filter 52, and on/off operations of on/off valves (V31~V33) and supply control valve 57, they are the same as in those described in the fifth embodiment, and thus their descriptions are omitted here.

Figure 42:
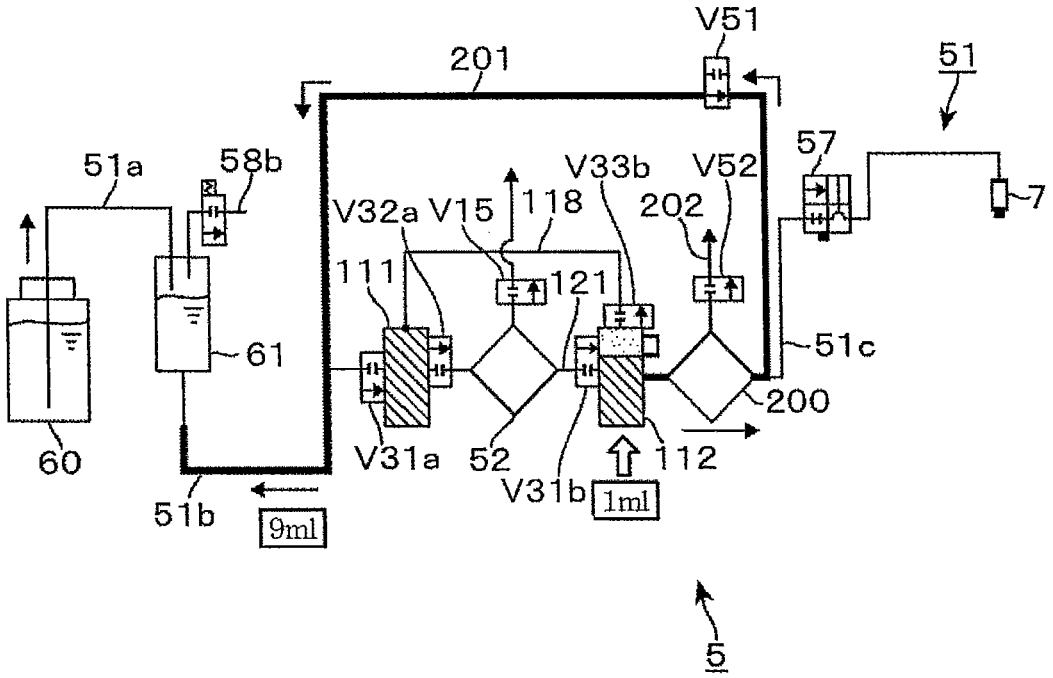
FIG. 42 is a cross-sectional view schematically showing a processing-liquid circulation operation in the liquid-processing apparatus of the seventh embodiment.

Next, when resist liquid (L) is returned to the upstream side of supply pump 111, on/off valve (V51) of reverse-flow channel 201 is opened, while other on/off valves (V31~V33) and supply control valve 57 are closed as shown in FIG. 42. Then, when advancing/retreating member 114 of discharge pump 112 advances, resist liquid (L) in discharge pump 112 passes through filter 200, flows through reverse-flow channel 201, and reaches the downstream side of buffer tank 61 (on the upstream side of supply pump 111).

In the seventh embodiment, when resist liquid (L) flows into discharge nozzle 7, resist liquid (L) passes through filter 200. Thus, even when particles are generated in discharge pump 112, such particles are captured in the filter and clean resist liquid (L) is supplied onto a wafer. Also, when resist liquid (L) in discharge pump 112 is returned to the upstream side of supply pump 111, the resist liquid (L) passes through filter 200. Thus, even if particles are generated in discharge pump 112, such particles are also captured in the filter.

Figure 43:
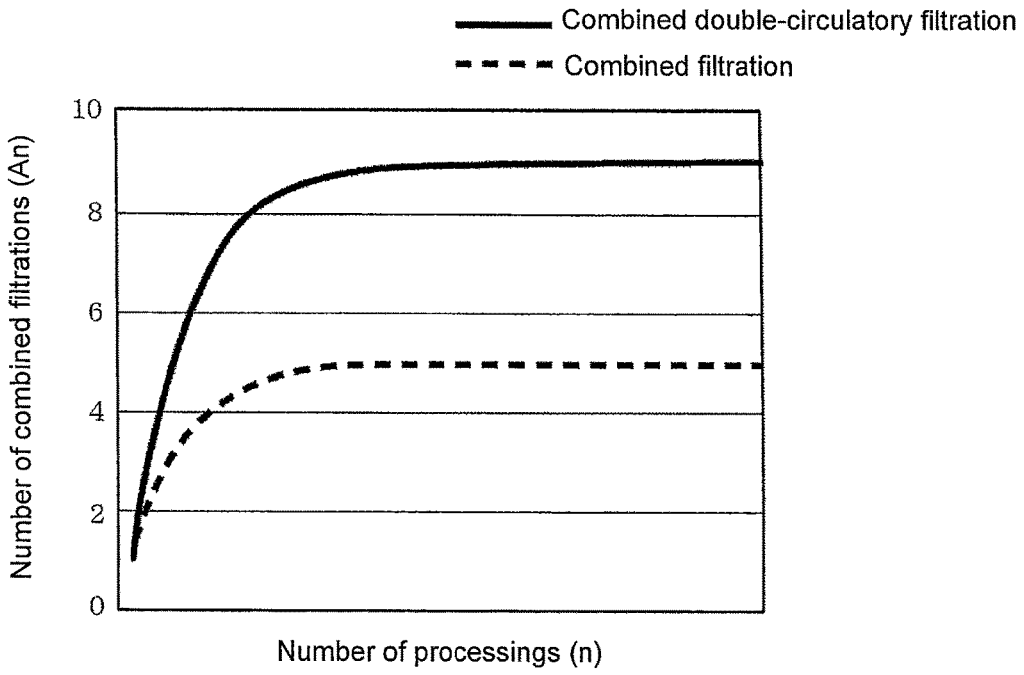
FIG. 43 is a graph showing the number of combined filtrations with respect to a ratio of the discharge amount of a resist liquid onto a wafer to the return amount.

FIG. 43 is a graph showing the calculation results of combined filtration (in which resist liquid (L) does not pass through filter 52 when returning to the upstream side of filter 52) and combined double-circulatory filtration (in which resist liquid (L) passes through filter 52 when returning to the upstream side of filter 52). Namely, regarding combined filtration, as described with reference to FIG. 13, when supply amount "a" on a wafer and return amount "b" to the upstream side of filter 52 are set at a ratio of 1:8 (a: 0.5 mL, b: 4 mL), the number of combined filtrations converges to 5. By contrast, when the ratio of "a" to "b" in combined double-circulatory filtrations is also set at 1:4, the number of combined filtrations calculated according to formula (2) above converges to 9. In addition, if the ratio is set at 1:2 (a: 0.5 mL, b: 1.0 mL) when conducting combined filtration and combined double-circulatory filtration, their respective numbers of combined filtrations are 3 and 5. Accordingly, at either ratio in approximately the same duration, approximately twice as many filtrations are achieved in the combined double-circulatory filtration as in the combined filtration.

As seen in FIG. 13, when combined filtration and combined double-circulatory filtration are conducted in the present application, the return amount "b" of resist liquid (L) to the upstream side of filter 52 is preferred to be set equal to or greater than the supply amount "a" of resist liquid (L) onto a wafer. Relative to the supply amount "a" of resist liquid (L) to a wafer, if the return amount "b" of resist liquid (L) to the upstream side of filter 52 is too much, processing time tends to increase, and if the return amount "b" is too small, the cleansing effect of resist liquid (L) is lowered. Thus, the ratio (a:b) is preferred to be 1:1~1:20, more preferably 1:1~1:10, even more preferably 1:1~1:5.

When two pumps (111, 112) are used as described above, the aforementioned trap tank 53 may be provided at least either between processing-liquid vessel 60 and supply pump 111, between supply pump 111 and filter 52, between filter 52 and discharge pump 112, or between discharge pump 112 and discharge nozzle 7.

Among two pumps (111, 112) described in the fifth through seventh embodiments, it is an option not to conduct a discharging operation at supply pump 111, but to use only discharge pump 112 on the downstream side of filter 52 so that suction and discharge of resist liquid (L) are conducted the same as those in the first through fourth embodiments.

In the above first through seventh embodiments, an operation for discharging resist liquid (L) from pump 70 (discharge pump 112) onto a wafer and an operation for returning resist liquid (L) remaining in pump 70 (discharge pump 112) to the upstream side of filter 52 are set as paired operations. Then, the paired operations are repeated. Thus, while discharging resist liquid (L) to wafers, in other words, while the apparatus is not idling but is running, contaminants and bubbles contained in resist liquid (L) are removed.

Here, instead of alternately repeating the discharge operation and return operation, it is an option to conduct multiple discharge operations, followed by conducting a return operation once, and further conducting multiple discharge operations. More specifically, when resist liquid (L) is returned from pump 70 (discharge pump 112) to the upstream side of filter 52, enough resist liquid (L) to be discharged multiple times to wafers (twice, for example) is left in pump 70 (discharge pump 112). Next, the amount of resist liquid (L) left in pump 70 (discharge pump 112) is discharged consecutively to multiple wafers. Then, resist liquid (L) is refilled through filter 52 to pump 70 (discharge pump 112). Therefore, in the scope of patent claims in the present invention, the "remaining processing liquid," described as the amount of resist liquid (L) to be returned to the upstream side of filter 52, includes the entire remaining liquid in pump 70 (discharge pump 112) as well as only a portion of the remaining liquid.

In addition, in the above first through seventh embodiments, when resist liquid (L) is refilled into pump (70 or 111) after resist liquid (L) is discharged from discharge nozzle 7, resist liquid (L) is refilled in an amount corresponding to the amount discharged from nozzle 7. However, the discharge amount may be set different from the refill amount to pump (70 or 111). Namely, the flow rate of resist liquid (L) to be drawn to pump (70 or 111) may be set at an optional rate by adjusting the amount of air to be supplied to driving chamber 73 of pump 70, or by adjusting the advancing or retreating degree of advancing/retreating member 114 of pump 111.

A more specific description is given below for an example where the discharge amount is set different from the refill amount. For example, in the (n)th discharge operation, the discharge amount, return amount to be returned to the upstream side of filter 52, and the refill amount of resist liquid (L) are set respectively at 0.5 mL, 2.4 mL and 0.6 mL. Then, in the (n+1)th discharge operation, the discharge amount, return amount and the refill amount are set respectively at 0.5 mL, 2.6 mL and 0.4 mL. Then, two such patterns may be alternately repeated.

Pump 70 may be used to replace the structure shown in FIG. 28 of at least either pump (111 or 112) in the fifth through seventh embodiments.

In photolithographic processes, for various reasons there are risks that bubbles of N2 gas or the like or particles (contaminants) will be mixed into processing liquid such as resist liquid and a developing solution supplied to wafers or the like. Then, when a processing liquid with bubbles or particles mixed therein is supplied onto wafers or the like, coating irregularities, defects or the like may occur. Thus, liquid processing apparatuses for coating processing liquid on wafers or the like uses a filter device so that bubbles and particles in the processing liquid are removed through filtration.

As an apparatus for enhanced filtration efficiency to remove bubbles or particles mixed into a processing liquid, there is a liquid processing apparatus where multiple filter devices are provided and the processing liquid is supplied to wafers or the like after passing through those filter devices. However, multiple filter devices installed in a liquid processing apparatus cause the apparatus to be large-scale, resulting in significant structural changes of the apparatus.

In a liquid processing apparatus where chemical liquid (processing liquid) is returned to a first vessel (buffer vessel) after it is filtered through a filter device and the chemical liquid that has returned to the first vessel is discharged onto a wafer, the chemical liquid that has returned to the first vessel is circulated multiple times to conduct multiple filtrations so that the filtration efficiency of the chemical liquid is enhanced.

A processing-liquid supply apparatus and a processing-liquid supply method according to embodiments of the present invention are capable of cleansing processing liquid by using one filter device and keeping throughput from lowering.

A processing-liquid supply apparatus according to an embodiment of the present invention is structured to have a processing-liquid supply source to supply processing liquid for processing a target substrate; a discharge device that is connected to the processing-liquid supply source via a supply channel and is for discharging the processing liquid onto the target substrate; a filter device that is provided for the supply channel and is for removing contaminants in the processing liquid; a pump device provided for the supply channel; and a control device that outputs control signals to execute the following: a step for discharging from the discharge device a portion of the processing liquid that has flowed from the upstream side of the filter device through the filter device toward its downstream side by using the suction force of the pump device, a step for returning the processing liquid that has flowed to the downstream side, except for the discharged portion, to the upstream side of the filter device; and a step for passing the processing liquid that has returned to the upstream side of the filter device, along with the processing liquid refilled from the processing-liquid supply source, through the filter device from its upstream side to its downstream side by using the pump device. In such an apparatus, the return amount of processing liquid is set greater than the discharge amount to be discharged from the discharge device.

As an embodiment of a processing-liquid supply apparatus, the structure may be modified as follows:

A structure in which the amount of processing liquid to be refilled from the processing-liquid supply source corresponds to the amount of processing liquid discharged from the discharge device.

A structure having a reverse-flow channel that includes a flow channel provided outside the filter device, and where the remaining processing liquid is returned to the upstream side of the filter device via the reverse-flow channel.

A structure in which a trap tank for trapping and exhausting bubbles is provided on the downstream side of the filter device, and the trap tank is provided for the reverse-flow channel.

A structure in which the reverse-flow channel is formed with a first reverse-flow channel connecting the discharge side of the pump device and the upstream side of the filter device, a flow channel inside the filter device, and a second reverse-flow channel connecting the downstream side and the upstream side of the filter device. In such a structure, the control device outputs control signals so that the remaining processing liquid returns to the upstream side of the filter device by way of the first reverse-flow channel, the filter device, and the second reverse-flow channel.

A structure, having a discharge pump device corresponding to the pump device provided for the downstream side of the filter device along the supply channel, and a supply pump device provided for the upstream side of the filter device along the supply channel. In such a structure, the control device outputs control signals so that the remaining processing liquid is returned to the upstream side of the filter device using the discharge pump device and the supply pump device, while processing liquid from the processing-liquid supply source is refilled to the supply pump device.

A structure, further having a reverse-flow channel that includes a flow channel provided outside the filter device, where the remaining processing liquid returns to the upstream side of the supply pump device via the reverse-flow channel.

A structure, in which the reverse-flow channel is formed of a third reverse-flow channel formed from the discharge side of the discharge pump device to a point between the discharge side of the supply pump device and the upstream side of the filter device, a flow channel inside the filter device, and a fourth reverse-flow channel formed from a point between the downstream side of the filter device and the suction side of the discharge pump device to the suction side of the supply pump device. In such a structure, the control device outputs control signals so that the remaining processing liquid returns to the suction side of the supply pump device by way of the third reverse-flow channel, the filter device, and the fourth reverse-flow channel.

In a processing-liquid supply method for supplying processing liquid to a target substrate after the processing liquid passes through a filter device to remove contaminants, a processing-liquid supply method according to an embodiment of the present invention includes the following steps: a step for discharging from the discharge device a portion of the processing liquid that has flowed from the upstream side of the filter device through the filter device to the downstream side using the suction force of a pump device provided for a supply channel; a return step for returning to the upstream side of the filter device the remaining processing liquid, which is the rest of the processing liquid that has flowed to the downstream side; and a step for flowing the processing liquid that has returned to the upstream side of the filter device along with the processing liquid that is refilled from the processing-liquid supply source from the upstream side of the filter device through the filter device to the downstream side using the pump device. In such a method, the amount of the processing liquid returned to the filter device is set to be equal to or greater than the amount of the processing liquid discharged from the discharge device.

In a processing-liquid supply apparatus and a processing-liquid supply method according to embodiments of the present invention, a portion of the processing liquid passing through a filter device is discharged from a discharge device and the remaining processing liquid is returned to the upstream side of the filter device. Then, the amount of processing liquid to be returned to the upstream side of the filter device is set equal to or greater than the amount of processing liquid to be discharged from the discharge device. Thus, using one filter device, filtration efficiency is achieved at the same level as that using multiple filter devices, while a decrease in throughput is suppressed.

Obviously, numerous modifications and variations of the present invention are possible in light of the above teachings. It is therefore to be understood that within the scope of the appended claims, the invention may be practiced otherwise than as specifically described herein.

What is claimed is:

1. A processing-liquid supply apparatus, comprising:

a processing-liquid supply source of a processing liquid for processing a target substrate;

a discharge nozzle device which discharges the processing liquid to the target substrate;

a supply channel connecting the processing-liquid supply source and the discharge nozzle device such that the processing liquid is supplied to the target substrate;

a filter device which is positioned in the supply channel and forming a first side having the processing-liquid supply source and a second side having the discharge nozzle device such that the filter device removes contaminant from the processing liquid;

a pump device which is positioned in the supply channel and suctions and discharges the processing liquid in the supply channel; and a control device built into a control computer configured to control suction and discharge by the pump device, wherein the control device built into the control computer is configured to control the pump device such that a discharge portion of the processing liquid flowed to the second side is discharged from the discharge nozzle device, that a remaining portion of the processing liquid on the second side is suctioned to be returned to the first side and that the remaining portion of the processing liquid returned to the first side flows from the first side toward the second side together with a refill portion of the processing liquid from the processing-liquid supply source, and the control device built into the control computer is set such that a return amount of the processing liquid to the filter device is equal to or greater than an amount of the discharge portion of the processing liquid.

2. A processing-liquid supply apparatus according to claim 1, wherein an amount of the refill portion of the processing liquid from the processing-liquid supply source corresponds to the amount of the discharge portion of the processing liquid.

3. A processing-liquid supply apparatus according to claim 1, wherein the supply channel includes a reverse-flow channel through which the remaining portion of the processing liquid is returned to the first side of the filter device.

4. A processing-liquid supply apparatus according to claim 3, further comprising:

a trap tank which traps and exhausts bubbles in the processing liquid and is positioned on the second side of the filter device in the reverse-flow channel.

5. A processing-liquid supply apparatus according to claim 3, wherein the reverse-flow channel includes a first reverse-flow channel connecting a discharge side of the pump device and the first side of the filter device and a second reverse-flow channel connected to a flow channel inside the filter device between the second side and the first side of the filter device, and the control device built into the control computer is configured to control the supply channel such that the remaining portion of the processing liquid returns to the first side of the filter device via the first reverse-flow channel and the second reverse-flow channel.

6. A processing-liquid supply apparatus according to claim 1, further comprising:

a supply pump device which is positioned on the first side of the filter device and supplies the processing liquid, wherein the pump device is a discharge pump device which is positioned on the second side of the filter device, and the control device built into the control computer is configured to control the supply pump device and the discharge pump device such that the discharge pump device and the supply pump device return the remaining portion of the processing liquid to the first side of the filter device and supply the refill portion of the processing liquid from the processing-liquid supply source to the supply pump device.

7. A processing-liquid supply apparatus according to claim 6, further comprising:

a reverse-flow channel positioned outside the filter device, wherein the remaining portion of the processing liquid is returned to a suction side of the supply pump device via the reverse-flow channel.

8. A processing-liquid supply apparatus according to claim 7, wherein the reverse-flow channel includes a third reverse-flow channel formed from a discharge side of the discharge pump device to a point between a discharge side of the supply pump device and the first side of the filter device, a flow channel inside the filter device and a fourth reverse-flow channel formed from a point between the second side of the filter device and a suction side of the discharge pump device to a suction side of the supply pump device, and the control device built into the control computer is configured to control the supply channel such that the remaining portion of the processing liquid returns to the suction side of the supply pump device via the third reverse-flow channel, the filter device and the fourth reverse-flow channel.

9. A method for supplying processing liquid, comprising:

flowing a processing liquid from a first side of a filter device to a second side of the filter device through the filter device such that contaminant in the processing liquid is removed;

discharging a discharge portion of the processing liquid flowed from the first side of the filter device to the second side of the filter device from a discharge nozzle device onto a target substrate;

returning a remaining portion of the processing liquid in the second side to the first side of the filter device; and passing the remaining portion of the processing liquid returned to the first side of the filter device together with a refill portion of the processing liquid from a processing-liquid supply source, wherein an amount of the processing liquid returned to the filter device is set to be equal to or greater than an amount of the discharge portion of the processing liquid discharged from the discharge nozzle device.

10. A method for supplying processing liquid according to claim 9, wherein an amount of the refill portion of the processing liquid from the processing-liquid supply source corresponds to the amount of the discharge portion of the processing liquid.

11. A method for supplying processing liquid according to claim 9, wherein the remaining portion of the processing liquid is returned to the first side of the filter device via a reverse-flow channel formed outside the filter device.

12. A method for supplying processing liquid according to claim 11, wherein the reverse-flow channel includes a first reverse-flow channel connecting a discharge side of a pump device and the first side of the filter device and a second reverse-flow channel connected to a flow channel inside the filter device between the second side and the first side of the filter device, the pump device is positioned in a supply channel and suctions and discharges the processing liquid in the supply channel connecting the processing liquid-supply source and the discharge nozzle device, and the remaining portion of the processing liquid is returned to the first side of the filter device via the first reverse-flow channel and the second reverse-flow channel.

13. A method for supplying processing liquid according to claim 9, wherein the pump device is a discharge pump device positioned on the second side of the filter device, the discharge pump device and a supply pump device positioned on the first side of the filter device return the remaining portion of the processing liquid to the first side of the filter device and supply the refill portion of the processing liquid from the processing-liquid supply source to the supply pump device.

14. A method for supplying processing liquid according to claim 13, wherein the remaining portion of the processing liquid is returned to a suction side of the supply pump device via a reverse-flow channel formed outside the filter device.

15. A method for supplying processing liquid according to claim 14, wherein the reverse-flow channel includes a third reverse-flow channel formed from a discharge side of the discharge pump device to a point between a discharge side of the supply pump device and the first side of the filter device, a flow channel inside the filter device and a fourth reverse-flow channel formed from a point between the second side of the filter device and a suction side of the discharge pump device to a suction side of the supply pump device, and the remaining portion of the processing liquid is returned to the suction side of the supply pump device via the third reverse-flow channel, the filter device and the fourth reverse-flow channel.

16. A processing-liquid supply apparatus, comprising:

a processing-liquid supply source of a processing liquid for processing a target substrate;

discharging means for discharging the processing liquid to the target substrate;

a supply channel connecting the processing-liquid supply source and the discharging means such that the processing liquid is supplied to the target substrate;

filtering means for removing contaminant from the processing liquid, the filtering means being positioned in the supply channel and forming a first side having the processing-liquid supply source and a second side having the discharging means;

pumping means for suctioning and discharging the processing liquid in the supply channel device, the pumping means being positioned in the supply channel; and a control device built into a control computer configured to control suction and discharge by the pumping means, wherein the control device built into the control computer is configured to control the pumping means such that a discharge portion of the processing liquid flowed to the second side is discharged from the discharging means, that a remaining portion of the processing liquid on the second side is suctioned to be returned to the first side and that the remaining portion of the processing liquid returned to the first side flows from the first side toward the second side together with a refill portion of the processing liquid from the processing-liquid supply source, and the control device built into the control computer is set such that a return amount of the processing liquid to the filtering means is equal to or greater than an amount of the discharge portion of the processing liquid.

17. A processing-liquid supply apparatus according to claim 16, wherein an amount of the refill portion of the processing liquid from the processing-liquid supply source corresponds to the amount of the discharge portion of the processing liquid.

18. A processing-liquid supply apparatus according to claim 16, wherein the supply channel includes a reverse-flow channel through which the remaining portion of the processing liquid is returned to the first side of the filtering means.

19. A processing-liquid supply apparatus according to claim 18, further comprising:

trapping means for trapping and exhausting bubbles in the processing liquid, the trapping means being positioned on the second side of the filtering means in the reverse-flow channel.

20. A processing-liquid supply apparatus according to claim 18, wherein the reverse-flow channel includes a first reverse-flow channel connecting a discharge side of the pumping means and the first side of the filtering means and a second reverse-flow channel connected to a flow channel inside the filtering means between the second side and the first side of the filtering means, and the control device built into the control computer is configured to control the supply channel such that the remaining portion of the processing liquid returns to the first side of the filtering means via the first reverse-flow channel and the second reverse-flow channel.

* * * * *